US011186955B2

(12) United States Patent
Siao et al.

(10) Patent No.: US 11,186,955 B2
(45) Date of Patent: Nov. 30, 2021

(54) LINKAGE BRICK ASSEMBLY AND ASSEMBLY METHOD THEREOF

(71) Applicant: JING SI PURELAND CO., LTD., Taipei (TW)

(72) Inventors: Marshall Q. Siao, Hualien County (TW); Cheng Yen Shih, Hualien County (TW)

(73) Assignee: JING SI PURELAND CO., LTD., Taipei (TW)

( * ) Notice: Subject to any disclaimer, the term of this patent is extended or adjusted under 35 U.S.C. 154(b) by 67 days.

(21) Appl. No.: 16/859,982

(22) Filed: Apr. 27, 2020

(65) Prior Publication Data

US 2020/0256020 A1 Aug. 13, 2020

Related U.S. Application Data

(62) Division of application No. 16/368,861, filed on Mar. 29, 2019, now Pat. No. 10,676,874.

(30) Foreign Application Priority Data

May 15, 2018 (TW) ..... 10711644.6

(51) Int. Cl.
*E01C 5/00* (2006.01)
*E01C 9/00* (2006.01)
(Continued)

(52) U.S. Cl.
CPC ..... *E01C 5/00* (2013.01); *E01C 9/004* (2013.01); *E01C 11/00* (2013.01); *E01C 11/24* (2013.01); *E01C 5/20* (2013.01); *E01C 2201/12* (2013.01)

(58) Field of Classification Search
CPC ..... E01C 2201/12; E01C 11/00; E01C 5/00
See application file for complete search history.

(56) References Cited

U.S. PATENT DOCUMENTS 191,273 A * 5/1877 Waters ..... 404/38
1,096,267 A * 5/1914 Sammis ..... 404/38
(Continued)

FOREIGN PATENT DOCUMENTS

CN 1558031 A 12/2004
CN 105862537 A 8/2016
(Continued)

OTHER PUBLICATIONS

First Office Action and Search Report dated Jan. 27, 2021 issued by the China National Intellectual Property Administration for the counterpart China Patent Application No. 201810938103.0 of the parent application (U.S. Pat. No. 10,676,874 B2) of this divisional application.
First Office Action dated Nov. 27, 2020 issued by Japan Patent Office for the counterpart Japan Patent Application No. 2019-066492 of the parent application (U.S. Pat. No. 10,676,874 B2) of this divisional application.
(Continued)

*Primary Examiner* — Thomas B Will
*Assistant Examiner* — Katherine J Chu
(74) *Attorney, Agent, or Firm* — WPAT, P.C., Intellectual Property Attorneys; Anthony King

(57) ABSTRACT

A linkage brick assembly, comprising: a least one first linkage brick, at least one second linkage brick and at least one third linkage brick, each linkage brick comprising a top face, a bottom face and four side faces between the top face and the bottom face. Each of the side faces of the first linkage brick forms a traverse engaging groove extending laterally. Each of two opposite side faces of the four side faces of the second linkage brick forms a traverse engaging protrusion extending laterally and each of the other two opposite side faces forms a vertical engaging portion extending vertically. Each of the side faces of the third linkage brick forms a vertical engaging groove extending vertically.
(Continued)

Each of the traverse engaging grooves of the first linkage brick is used to engage with each of the traverse engaging protrusions of the second linkage brick through lateral sliding. Each of the vertical engaging grooves of the third linkage brick is used to engage with each of the vertical engaging protrusions of the second linkage brick through downward sliding. Assembly of the linkage brick assembly of a large area can be achieved by way of the interlocking of only three types of linkage bricks.

1 Claim, 31 Drawing Sheets

(51) Int. Cl.

| | |
|---|---|
| ***E01C 11/00*** | (2006.01) |
| ***E01C 11/24*** | (2006.01) |
| *E01C 5/20* | (2006.01) |

(56) References Cited

U.S. PATENT DOCUMENTS

| | | | | | |
|---|---|---|---|---|---|
| 1,186,673 | A * | 6/1916 | Mallet | E04F 15/04 52/592.1 |
| 7,429,144 | B1 | 9/2008 | Lai | |
| 8,671,640 | B1 * | 3/2014 | Thomas | A63H 33/105 52/586.2 |
| 2004/0250495 | A1 * | 12/2004 | Manthei | E01C 5/06 52/589.1 |
| 2009/0297267 | A1 * | 12/2009 | Glynn | E01C 5/18 404/41 |

FOREIGN PATENT DOCUMENTS

| | | | | | |
|---|---|---|---|---|---|
| CN | 206438362 | U | | 8/2017 | |
| DE | 1116695 | B | * | 11/1961 | E01C 5/00 |
| DE | 2634586 | A1 | | 9/1977 | |
| FR | 1210233 | A | * | 3/1960 | E01C 5/06 |
| GB | 1221611 | A | * | 2/1971 | E01C 5/06 |
| GB | 2342375 | A | | 4/2000 | |
| JP | S52-025436 | U | | 8/1975 | |
| JP | H01-167403 | U | | 11/1989 | |
| JP | H02-104439 | U | | 5/1992 | |
| JP | H05-047420 | U | | 3/1995 | |
| JP | H08-144213 | A | | 6/1996 | |
| JP | H09-302606 | A | | 11/1997 | |
| JP | 3053479 | U | | 10/1998 | |
| JP | 2001-011808 | A | | 1/2001 | |
| JP | 2004-293175 | A | | 10/2004 | |
| JP | 2008-099564 | A | | 5/2008 | |
| JP | 3145860 | U | | 10/2008 | |
| JP | 2011-106208 | A | | 6/2011 | |
| JP | 2013-136935 | A | | 7/2013 | |
| JP | 3187268 | U | | 11/2013 | |
| JP | 2014-025275 | A | | 2/2014 | |
| JP | 2015-124584 | A | | 7/2015 | |
| KR | 100889252 | B1 | | 3/2009 | |
| KR | 20210030196 | A | * | 3/2021 | |

OTHER PUBLICATIONS

English Translation of the first Office Action dated Nov. 27, 2020 issued by Japan Patent Office for the counterpart Japan Patent Application No. 2019-066492 of the parent application (U.S. Pat. No. 10,676,874 B2) of this divisional application.

JP3187268U is used to challenge the patentability of the counterpart Japan Patent Application No. 2019-066492 of the parent application (U.S. Pat. No. 10,676,874 B2) of this divisional application.

JP2013-136935A is used to challenge the patentability of the counterpart Japan Patent Application No. 2019-066492 of the parent application (U.S. Pat. No. 10,676,874 B2) of this divisional application.

JPH02-104439U (JPH04-061107U) is used to challenge the patentability of the counterpart Japan Patent Application No. 2019-066492 of the parent application (U.S. Pat. No. 10,676,874 B2) of this divisional application.

JPH09-302606A is used to challenge the patentability of the counterpart Japan Patent Application No. 2019-066492 of the parent application (U.S. Pat. No. 10,676,874 B2) of this divisional application.

JP2015-124584A is used to challenge the patentability of the counterpart Japan Patent Application No. 2019-066492 of the parent application (U.S. Pat. No. 10,676,874 B2) of this divisional application.

JPH08-144213A is used to challenge the patentability of the counterpart Japan Patent Application No. 2019-066492 of the parent application (U.S. Pat. No. 10,676,874 B2) of this divisional application.

JPH05-047420U (JPH07-17279U) is used to challenge the patentability of the counterpart Japan Patent Application No. 2019-066492 of the parent application (U.S. Pat. No. 10,676,874 B2) of this divisional application.

U.S. Pat. No. 7429144B1 is a prior art reference, which only relate to the state of art.

JP3145860U is a prior art reference, which only relate to the state of art.

JP2014-025275A is a prior art reference, which only relate to the state of art.

JP3053479U is a prior art reference, which only relate to the state of art.

JP2001-011808A is a prior art reference, which only relate to the state of art.

JP2004-293175A is a prior art reference, which only relate to the state of art.

JP2008-099564A is a prior art reference, which only relate to the state of art.

JPH01-167403U is a prior art reference, which only relate to the state of art.

JP2011-106208A is a prior art reference, which only relate to the state of art.

JPS52-025436U (JPS50-110519U) is a prior art reference, which only relate to the state of art.

English Translation of JP3187268U.

English Translation of JP2013-136935A.

English Translation of JPH09-302606A.

English Translation of JP2015-124584A.

English Translation of JPH08-144213A.

* cited by examiner

LINKAGE BRICK ASSEMBLY AND ASSEMBLY METHOD THEREOF

BACKGROUND OF THE INVENTION

Field of the Invention

The present invention relates to a linkage brick assembly and an assembly method of the linkage brick assembly. In particular, the present invention relates to a linkage brick assembly and assembly method by which linkage bricks (also called interlocking bricks or interlocking paving bricks) can be quickly and easily assembled.

Discussion of the Background

The conventional linkage brick assembly is formed by assembling linkage bricks having structures that can match one another in an integral way, such that the advantage of convenient delivery and assembly can be obtained. However, the conventional linkage brick still has many shortcomings, for example, excessive weight, complicated assembling steps and not being able to be assembled simultaneously at multiple positions, which results in re-assembly that requires taking all portions apart once erroneous assembly occurs.

A conventional linkage brick can be seen in U.S. Pat. No. 7,429,144 and Taiwanese utility model patent TWM470115. In linkage bricks disclosed in the above patents or other conventional linkage bricks, the demand for assembly makes the linkage bricks comprise too many unnecessary engaging structures, for example, a linkage brick being polygonal requires that the engaging structure be formed on every side in order to satisfy the requirement for assembly.

Due to the polygonal configuration of the conventional linkage brick mentioned above, the areas of side faces thereof are relatively small, which further leads to a smaller engaging structure allowed to be formed on each side face and thus has a serious impact on the strength of the engaging structure. If the strength provided by the engaging structure is not sufficient, an up-and-down relative displacement of each linkage brick may result from pedestrians or vehicles passing through the linkage brick assembly, which will diminish the flatness of the linkage brick assembly.

Though an elastic latch is added to Taiwanese utility model patent TWM470115 to prevent the linkage bricks from disengagement and protrusion, such elastic latch increases the difficulty in disassembling, exchanging or repairing the linkage brick assembly because an additional tool is required for these activities.

Furthermore, the engaging structure (especially the engaging recess) of the conventional linkage brick extends so long that it forms an opening on the surface of the linkage brick, which will remain on the top face of the linkage brick and form an opening after the assembly of the linkage bricks. Such opening will cause rain to leak out or danger to walking pedestrians (for example, falling due to a heel of a shoe being trapped in the opening).

The linkage brick assembly of the subject invention is intended to solve the long-standing problems and defects of the conventional linkage bricks aforementioned. In addition, the subject invention uses special structural designs to obtain the advantage of easy and fast assembly.

SUMMARY OF THE INVENTION

According to one aspect of the subject invention, the subject invention provides a linkage brick assembly, comprising: at least one first linkage brick comprising a top face, a bottom face and four side faces between the top face and the bottom face, each of the side faces forming a traverse engaging groove extending laterally; at least one second linkage brick comprising a top face, a bottom face and four side faces between the top face and the bottom face, each of two opposite side faces of the side faces forming a traverse engaging protrusion extending laterally, and each of the other two opposite side faces of the side faces forming a vertical engaging protrusion extending vertically; and at least one third linkage brick comprising a top face, a bottom face and four side faces between the top face and the bottom face, each of the side faces forming a vertical engaging groove extending vertically; wherein each of the traverse engaging grooves of the first linkage brick is used to engage with each of the traverse engaging protrusions of the second linkage brick through lateral sliding, and each of the vertical engaging grooves of the third linkage brick is used to engage with each of the vertical engaging protrusions of the second linkage brick through downward sliding; and wherein a top face and an outer side face of each of the vertical engaging protrusions of the second linkage brick define a wedged corner, and each of the vertical engaging grooves of the third linkage brick correspondingly forms a wedged grooved portion, the wedged corner of each of the vertical engaging protrusions being used to engage with the wedged grooved portion of each of the vertical engaging grooves.

According to another aspect of the subject invention, the subject invention provides a unit assembled brick, comprising: four first linkage bricks, each comprising a top face, a bottom face and four side faces between the top face and the bottom face, each of the side faces forming a traverse engaging groove extending laterally; four second linkage bricks each comprising a top face, a bottom face and four side faces between the top face and the bottom face, each of two opposite side faces of the side faces forming a traverse engaging protrusion extending laterally, and each of the other two opposite side faces of the side faces forming a vertical engaging protrusion extending vertically; and a third linkage brick comprising a top face, a bottom face and four side faces between the top face and the bottom surface, each of the side faces forming a vertical engaging groove extending vertically; wherein a top face and an outer side face of each of the vertical engaging protrusions of the second linkage bricks defines a wedged corner, and each of the vertical engaging grooves of the third linkage brick correspondingly forms a wedged grooved portion; wherein the first linkage bricks engage with the second linkage bricks alternately, adjacent traverse engaging grooves of the first linkage bricks engage with adjacent traverse engaging protrusions of the second linkage bricks to form a hollow square ring that is arranged into a 3×3 array, and inner sides of the square ring have four vertical engaging protrusions of the second linkage bricks; wherein the third linkage brick is placed in the center of the hollow square ring and each of four vertical engaging grooves of the third linkage brick respectively engages with each of four vertical engaging protrusions of the second linkage bricks facing the inner sides of the square ring; and wherein the wedged corner of each of the vertical engaging protrusions of the second linkage bricks engages with the wedged grooved portion of each of the vertical engaging grooves of the third linkage brick.

According to another aspect of the subject invention, the subject invention provides a linkage brick assembly, comprising: a plurality of the unit assembled bricks, wherein each of the plurality of unit assembled bricks defines a top face, a bottom face and four side faces between the top face and the bottom face, each of the side faces forming a traverse engaging groove, a vertical engaging protrusion and a traverse engaging groove sequentially; a plurality of additional second linkage bricks, each comprising a top face, a bottom face and four side faces between the top face and the bottom face, each of two opposite side faces of the side faces forming a traverse engaging protrusion extending laterally, and each of the other two opposite side faces of the side faces forming a vertical engaging protrusion extending vertically; a plurality of additional third linkage bricks, each comprising a top face, a bottom face and four side faces between the top face and the bottom face, each of the side faces forming a vertical engaging groove extending vertically; wherein the traverse engaging protrusions of the plurality of second linkage bricks are used to engage with the traverse engaging grooves of the plurality of unit assembled bricks respectively through lateral sliding, and wherein the vertical engaging grooves of the plurality of third linkage bricks are used to engage with the vertical engaging protrusions of the plurality of unit assembled bricks through downward sliding in order to connect the plurality of unit assembled bricks.

According to another aspect of the subject invention, the subject invention provides a linkage brick assembly, comprising a plurality of second linkage bricks, each comprising a top face, a bottom face and four side faces between the top face and the bottom face, each of two opposite side faces of the side faces forming a traverse engaging protrusion extending laterally, and each of the other two opposite side faces of the side faces forming a vertical engaging protrusion extending vertically; a plurality of third linkage bricks, each comprising a top face, a bottom face and four side faces between the top face and the bottom face, each of the side faces forming a vertical engaging groove extending vertically; wherein a top face and an outer side face of each of the vertical engaging protrusions of the second linkage bricks defines a wedged corner, and each of the vertical engaging grooves of the third linkage bricks correspondingly forms a wedged grooved; portion; a plurality of unit linkage bricks, each comprising a top face, a bottom face and four side faces between the top face and the bottom face, each of the side faces forming a traverse engaging groove, a vertical engaging protrusion and a traverse engaging groove sequentially; wherein the traverse engaging protrusions of the plurality of second linkage bricks are used to engage with the traverse engaging grooves of the plurality of unit linkage bricks through lateral sliding respectively; and wherein the vertical engaging grooves of the plurality of third linkage bricks are used to engage with the vertical engaging protrusions of the plurality of unit linkage bricks through downward sliding in order to connect the plurality of unit linkage bricks.

To enable the persons familiar with the techniques of the field to better understand the specifics of the subject invention and carry out the claimed invention, detailed description for the embodiments is provided along with the drawings. The description only serves to describe the preferable embodiments of the subject invention and does not impose any restrictions thereon. Any modifications or variations made in the same spirit of the subject invention shall lie within the scope of protection of the subject invention.

DESCRIPTION OF THE EMBODIMENTS

Figure 1:
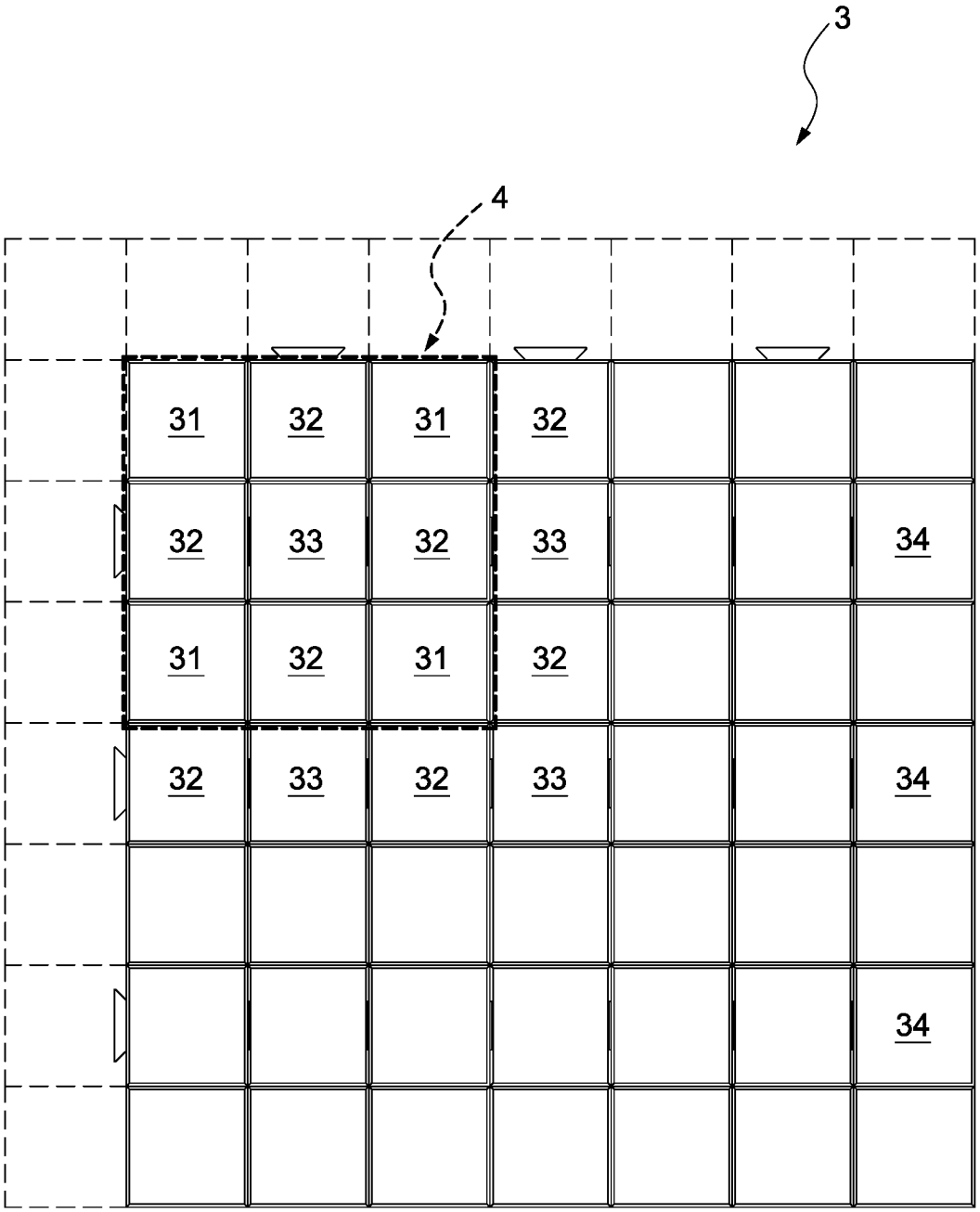
FIG. 1 is a top view of a linkage brick assembly in accordance with a first embodiment of the subject invention.

FIG. 1. illustrates a linkage brick assembly 3 in accordance with a first embodiment of the subject invention.

The linkage brick assembly 3 of the subject invention comprises at least one first linkage brick 31, a least one second linkage brick 32 and at least one third linkage brick 33.

As shown in FIGS. 2, 2A, 2B, 2C and 2D, the first linkage brick 31 comprises a top face 311, a bottom face 312 and four side faces 313, 314, 315, 316 between the top face 311 and the bottom face 312. Each of the side faces forms a traverse engaging groove 3131, 3141, 3151, 3161 extending laterally, and the traverse engaging grooves 3131, 3141, 3151, 3161 substantially extend horizontally and laterally.

As shown in FIGS. 3, 3A, 3B, 3C and 3D, the second linkage brick 32 comprises a top face 321, a bottom face 322 and four side faces 323, 324, 325, 326 between the top face 321 and the bottom face 322. Each of two opposite side faces 323, 325 of the side faces forms a traverse engaging protrusion 3231, 3251 extending laterally and each of the other two opposite side faces 324, 326 of the side faces forms a vertical engaging protrusion 3241, 3261 extending vertically. The traverse engaging protrusions 3231, 3251 substantially extend horizontally and laterally and the vertical engaging protrusions 3241, 3261 substantially extend in a direction perpendicular to the corresponding side faces 324, 326.

As shown in FIGS. 4, 4A, 4B, 4C and 4D, the third linkage brick 33 comprises a top face 331, a bottom face 332 and four side faces 333, 334, 335, 336 between the top face 331 and the bottom face 332. Each of the side faces forms a vertical engaging groove 3331, 3341, 3351, 3361 extending vertically, and the vertical engaging grooves 3331, 3341, 3351, 3361 preferably extend inwardly in a direction perpendicular to the corresponding side faces.

Figure 4:
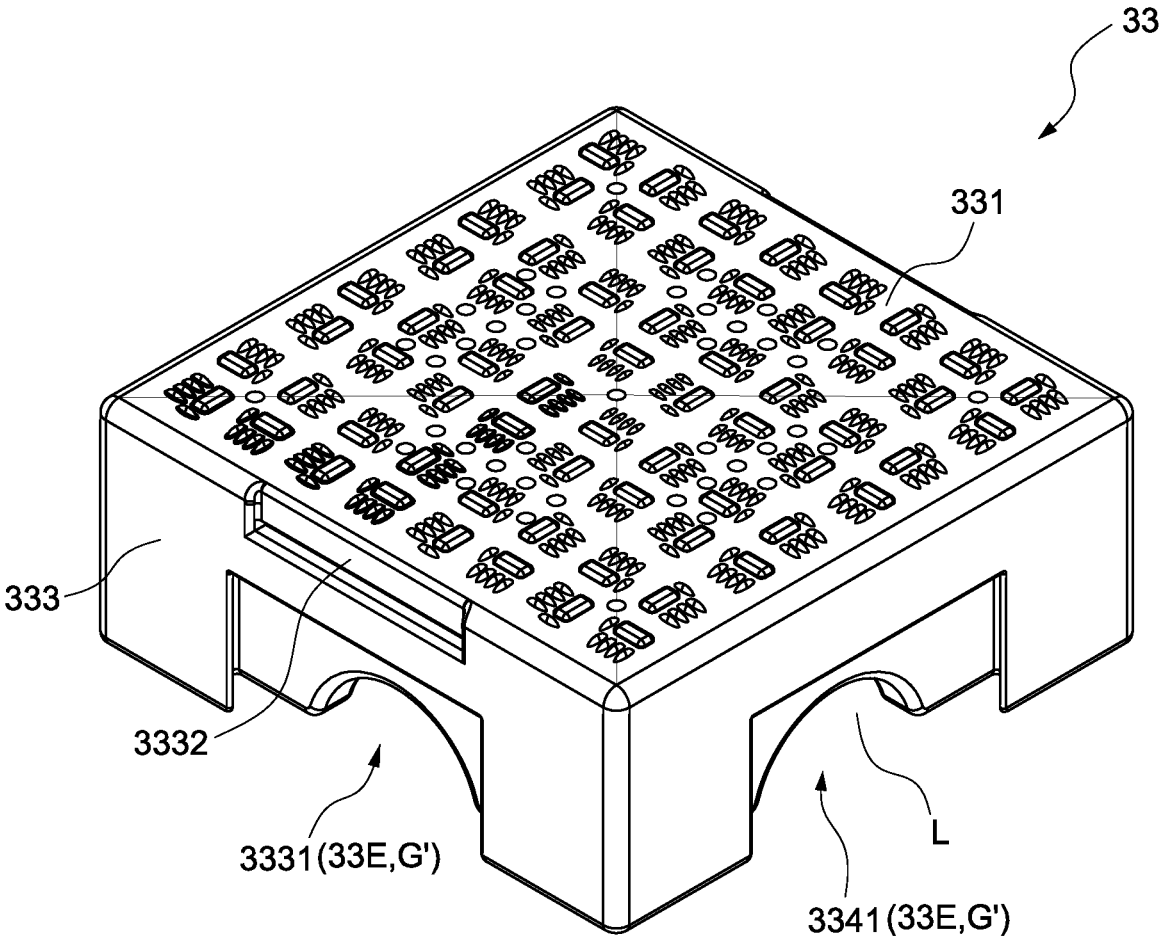
FIG. 4 is a perspective view of a third linkage brick of the linkage brick assembly in accordance with the first embodiment of the subject invention.
Figure 4A:
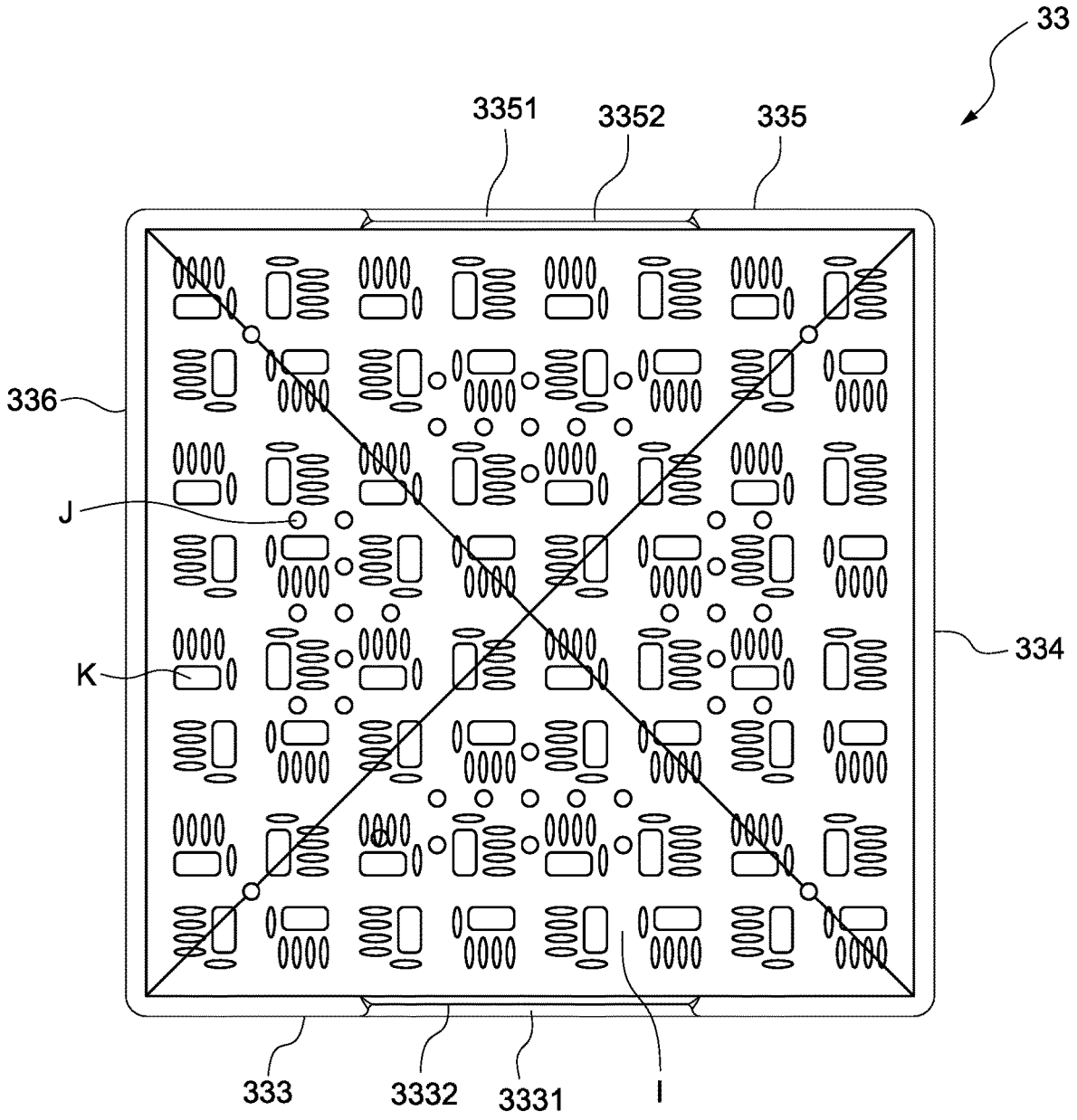
FIG. 4A is a top view of the third linkage brick shown in FIG. 4.
Figure 4B:
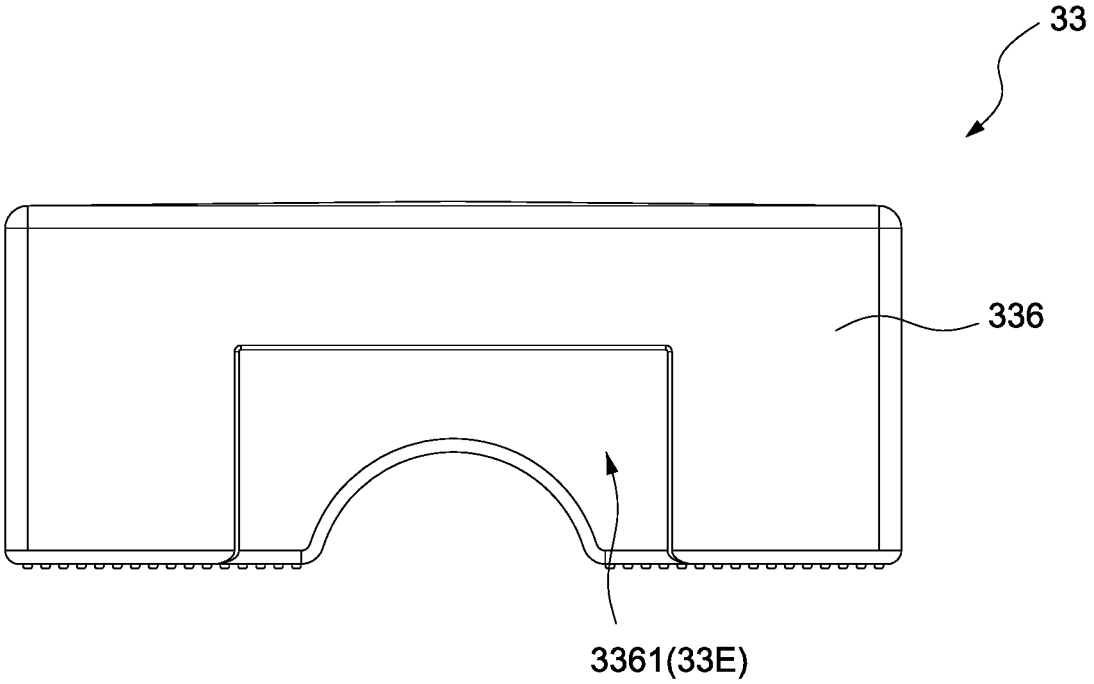
FIG. 4B is a side view illustrating one of two opposite side faces of the third linkage brick shown in FIG. 4.
Figure 4C:
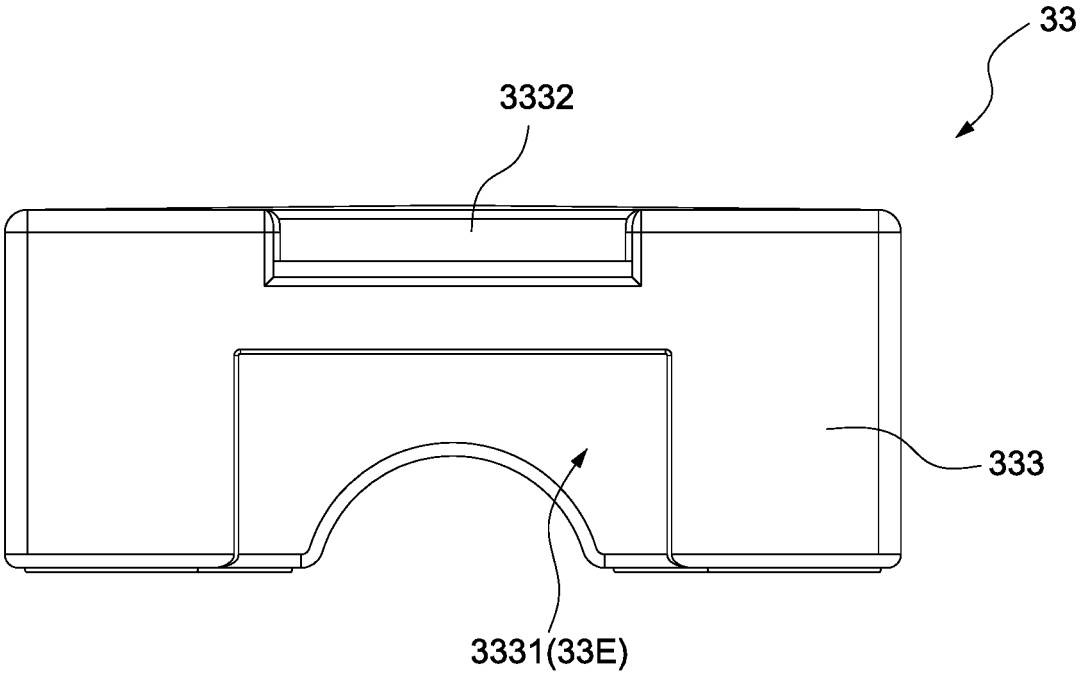
FIG. 4C is a side view illustrating the other of the two opposite side faces of the third linkage brick shown in FIG. 4.
Figure 4D:
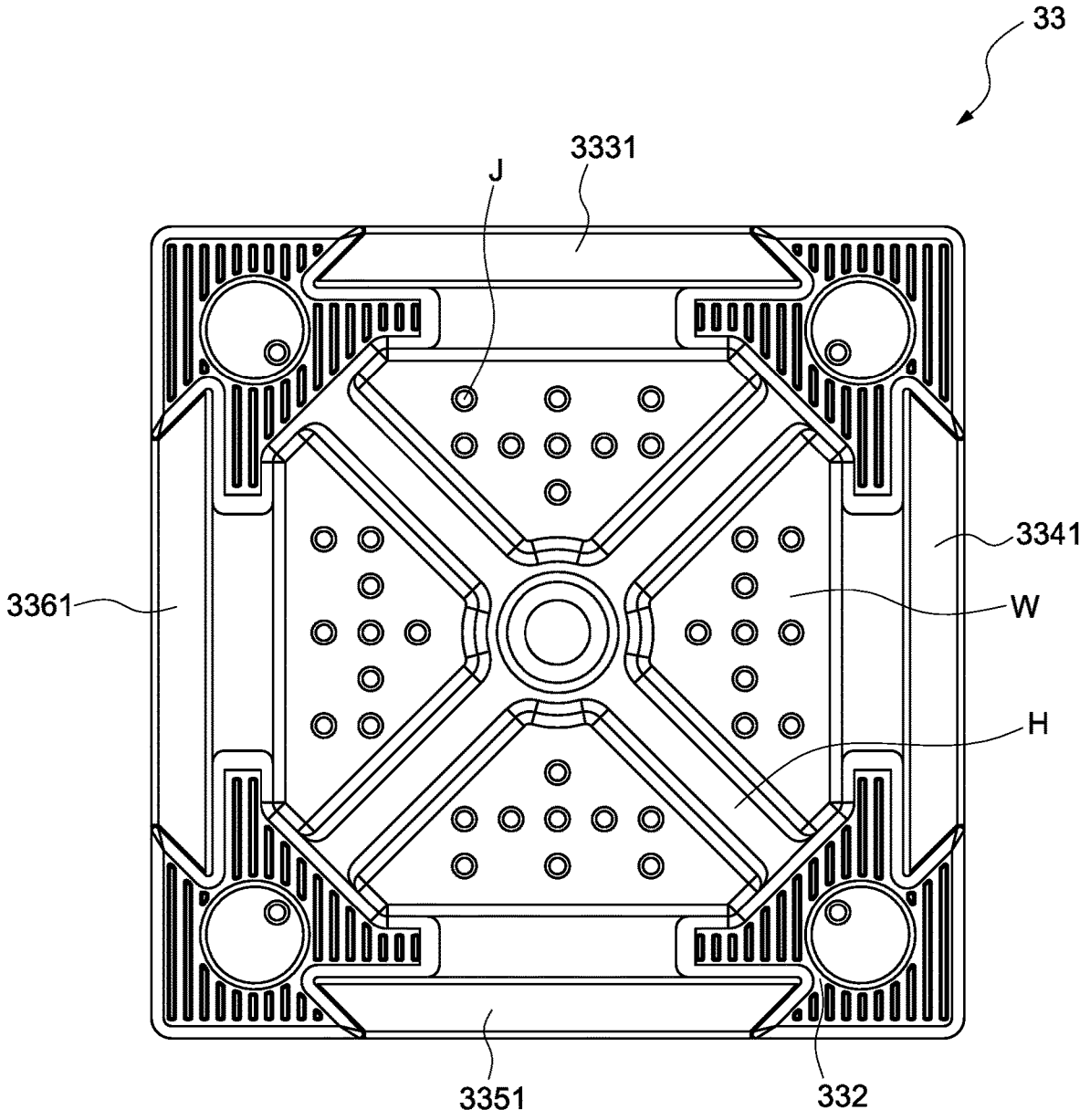
FIG. 4D is a bottom view of the third linkage brick shown in FIG. 4.

In addition, as shown in FIGS. 4, 4A and 4C, each of the at least two opposite side faces 333, 335 of the third linkage brick 33 additionally comprises at least a recess 3332, 3352 defined by the top face 333 and the side faces 333, 335 of the third linkage brick 33. The recess 3332, 3352 is preferably of an elongated form and configured to be suitable for an insertion of a tool for lifting the third linkage brick 33.

In the above embodiment, each of the traverse engaging grooves 3131, 3141, 3151, 3161 of the first linkage brick 31 engages with each of the traverse engaging protrusions 3231, 3251 of the second linkage brick 32 through lateral sliding. Each of the vertical engaging grooves 3331, 3341, 3351, 3361 engages with each of the vertical engaging protrusions 3241, 3261 of the second linkage brick 32 through sliding downward from the top.

Figure 3:
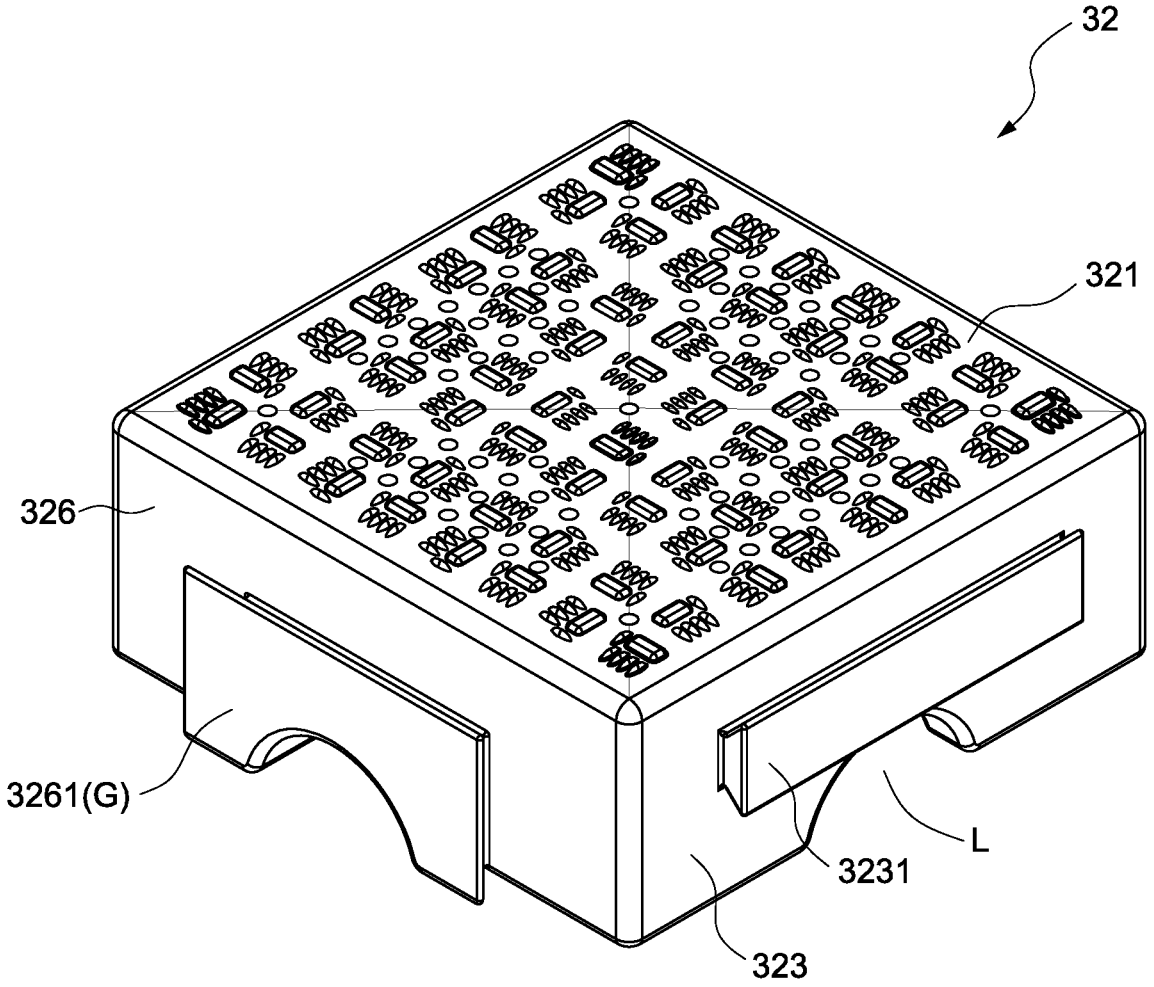
FIG. 3 is a perspective view of a second linkage brick of the linkage brick assembly in accordance with the first embodiment of the subject invention.
Figure 3A:
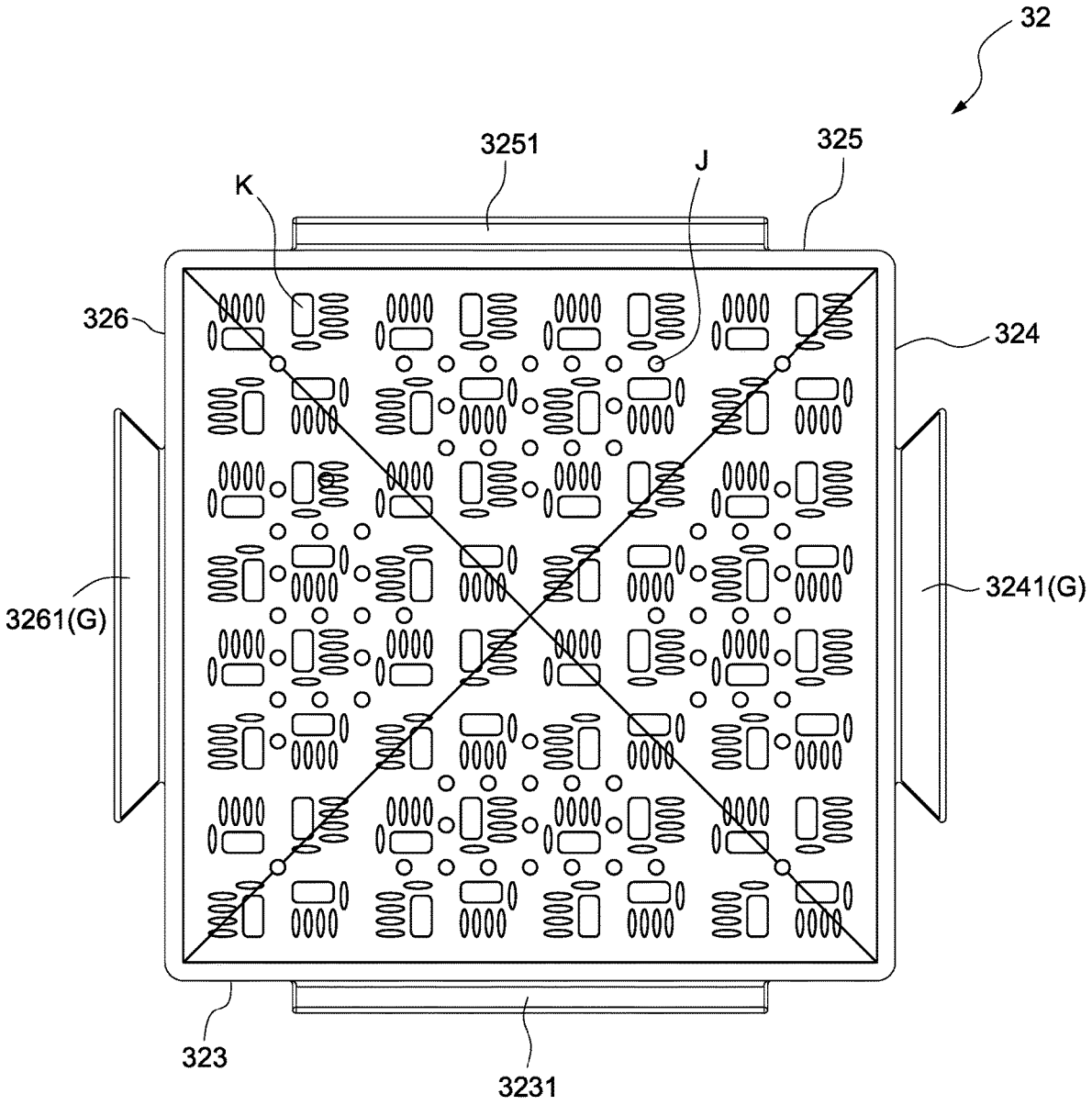
FIG. 3A is a top view of the second linkage brick shown in FIG. 3.
Figure 3B:
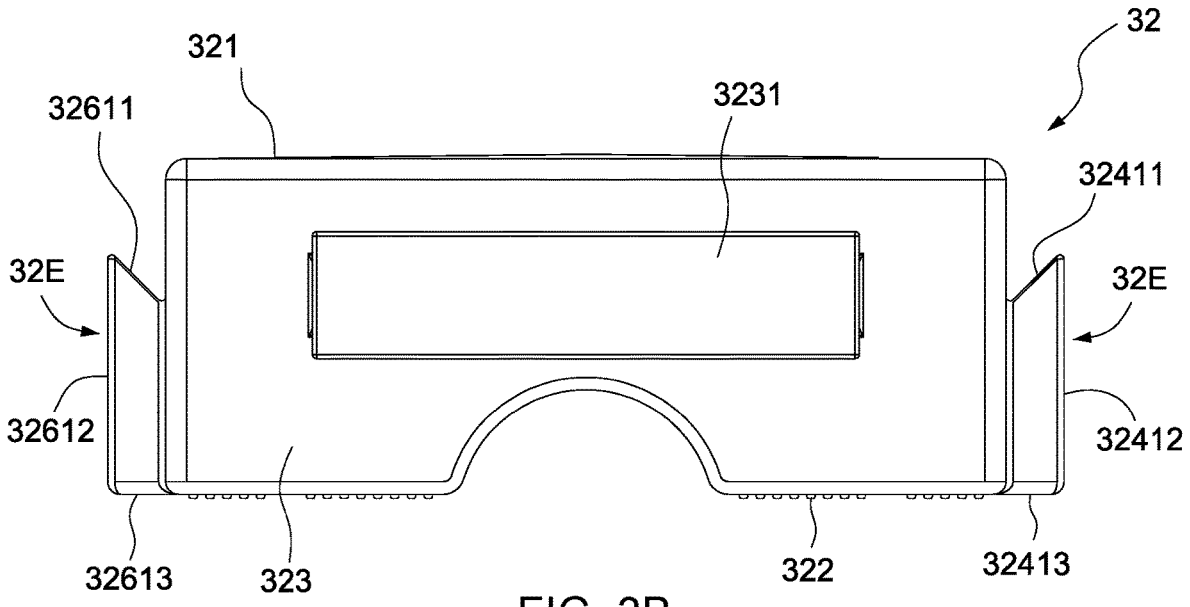
FIG. 3B is a side view illustrating one of two opposite side faces of the second linkage brick shown in FIG. 3.
Figure 3C:
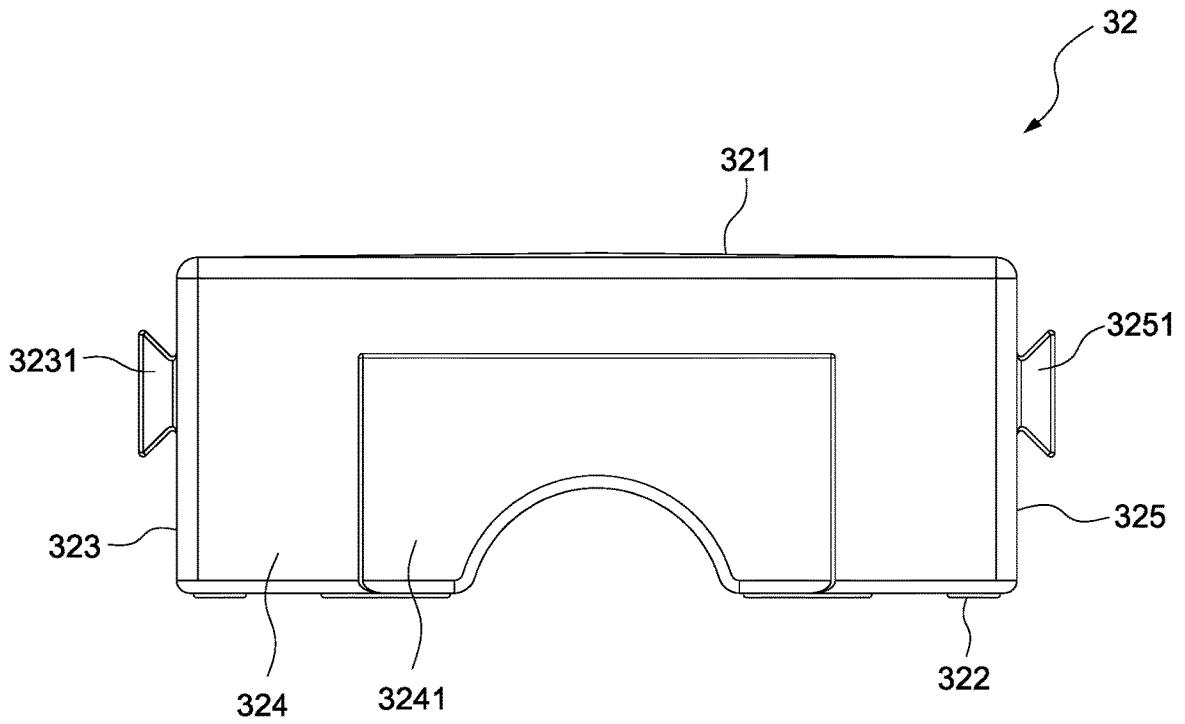
FIG. 3C is a side view illustrating the other of the two opposite side faces of the second linkage brick shown in FIG. 3.
Figure 3D:
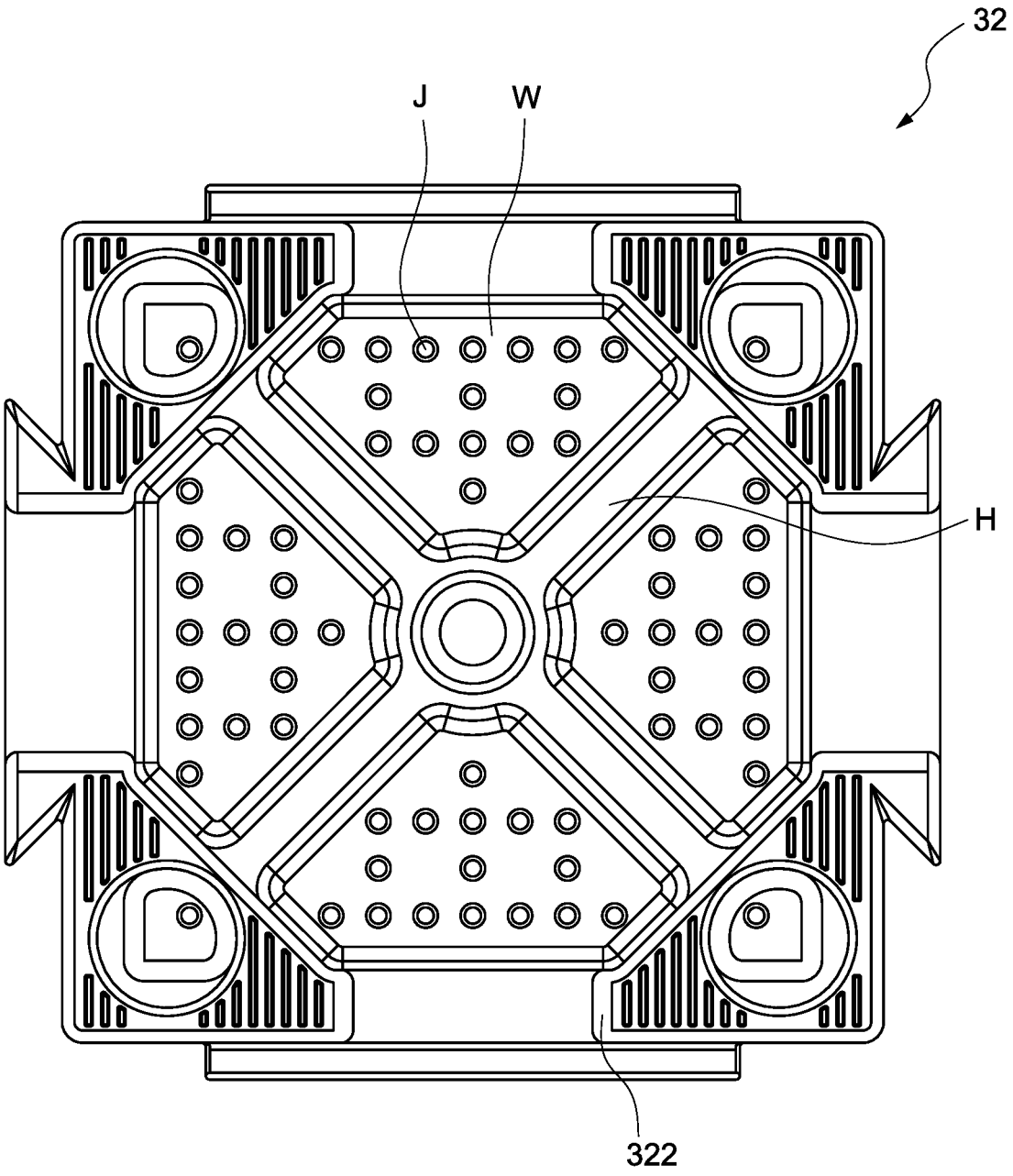
FIG. 3D is a bottom view of the second linkage brick shown in FIG. 3.

Further, as shown in FIG. 3B, a top face 32411, 32611 (closest to the top face 321 of the second linkage brick 32) of each of the vertical engaging protrusions 3241, 3261 of the second linkage brick 32 is slanted and, together with an outer side face 32412, 32612 of each of the vertical engaging protrusions 3241, 3261, define a wedged corner 32E. Each of the vertical engaging grooves 3331, 3341, 3351, 3361 of the third linkage brick 33 correspondingly forms a wedged grooved portion 33E. The wedged corner 32E of each of the vertical engaging protrusions 3241, 3261 of the second linkage brick 32 is used to engage with the wedged grooved portion 33E of each of the vertical engaging grooves 3331, 3341, 3351, 3361 of the third linkage brick 33. Preferably, each of the vertical engaging grooves 3331, 3341, 3351, 3361 engages with each of the vertical engaging protrusions 3241, 3261 downward from the top in a vertical direction.

In the above-mentioned embodiment of the subject invention, the mutual locking among each of the linkage bricks is achieved by means of the engaging structures (traverse engaging protrusion, traverse engaging groove, vertical engaging protrusion and vertical engaging groove) of the first linkage brick 31, the second linkage brick 32 and the third linkage brick 33. In particular, by means of the mutual locking of the engaging structures in the vertical direction and the lateral direction (horizontal direction), the assembly of the linkage brick assembly is easier and faster. Users therefore may choose the amount of the first linkage brick 31, the second linkage brick 32 and the third linkage brick 33 according to their demand and assemble them to obtain the desired structure of the linkage brick assembly 3.

The engaging structure of the conventional linkage brick disclosed in the U.S. Pat. No. 7,429,144 is a vertical engagement, and the female portion of the engaging structure goes through the linkage brick to the top face thereof. Consequently, when vehicles or pedestrians are passing the conventional linkage bricks, each of the linkage bricks of the conventional linkage brick assembly will generate relative vertical displacements, which makes the linkage bricks uneven and even further causes the linkage bricks to separate from one another.

In a preferable embodiment of the subject invention, the vertical engaging grooves 3331, 3341, 3351, 3361 of the third linkage brick 33 do not extend to the top face 331 of the third linkage brick 33 (as shown in FIGS. 4, 4B and 4C). The vertical engaging protrusions 3241, 3261 of the second linkage brick 32 do not extend to the top face 321 of the second linkage brick 32 (as shown in FIGS. 3 and 3B). Due to this feature, when vehicles or pedestrians are passing the linkage brick assembly 3 of the subject invention, the vertical engaging grooves 3331, 3341, 3351, 3361 and the vertical engaging protrusions 3241, 3261 of the linkage brick assembly 3, which do not extend to the top face, have an effect of preventing each of the linkage bricks from relative up-and-down displacement and separating from one another.

In addition, as shown in FIG. 3B, the bottom faces 32413, 32613 of the vertical engaging protrusions 3241, 3261 extend to the bottom face 322 of the second linkage brick 32, and preferably, the bottom faces 32413, 32613 are flush with the bottom face 322 of the second linkage brick 32.

In other possible embodiments, the traverse engaging protrusion 3231, 3251 of the second linkage brick 32 is configured to gradually enlarge outwardly from the side face 323, 325 and protrude to form a configuration such as a truncated triangular prism or a truncated triangular pyramid.

The vertical engaging protrusions 3241, 3261 and the vertical engaging grooves 3331, 3341, 3351, 3361 of the linkage brick assembly in some of the embodiments of the subject invention are structures specially designed so as to provide an engagement with high strength and, at the same time, are the structures which avoid extending to the top faces 321, 331 of the linkage bricks.

In the embodiments of the subject invention, the third linkage brick 33 serves as a so-called key stone, which is intended especially for the locking after the second linkage brick 32 (or the fourth linkage brick 32 mentioned hereinafter) slides laterally to engage with the first linkage brick 31.

Figure 6:
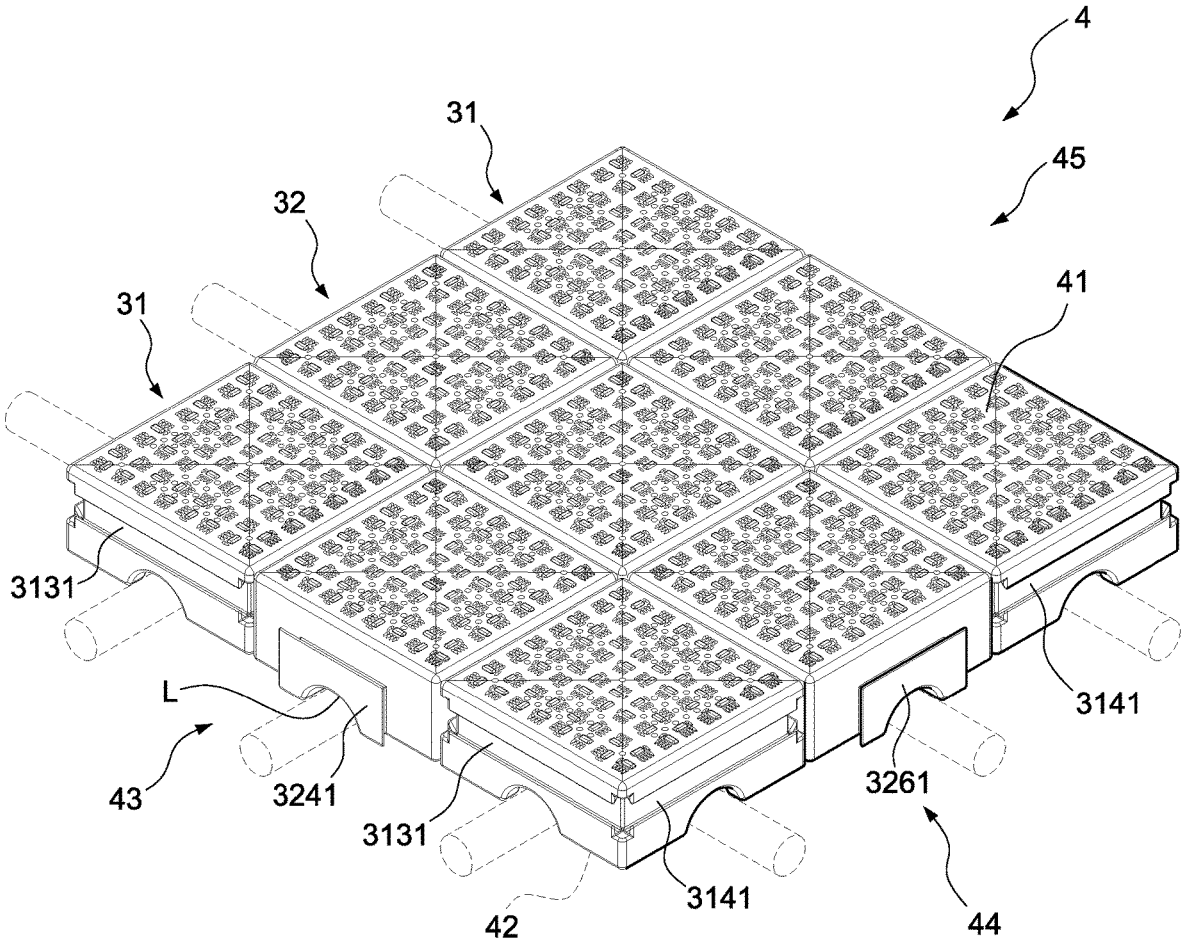
FIG. 6 is a perspective view of a unit assembled brick of the linkage brick assembly in accordance with the first embodiment of the subject invention.
Figure 6A:
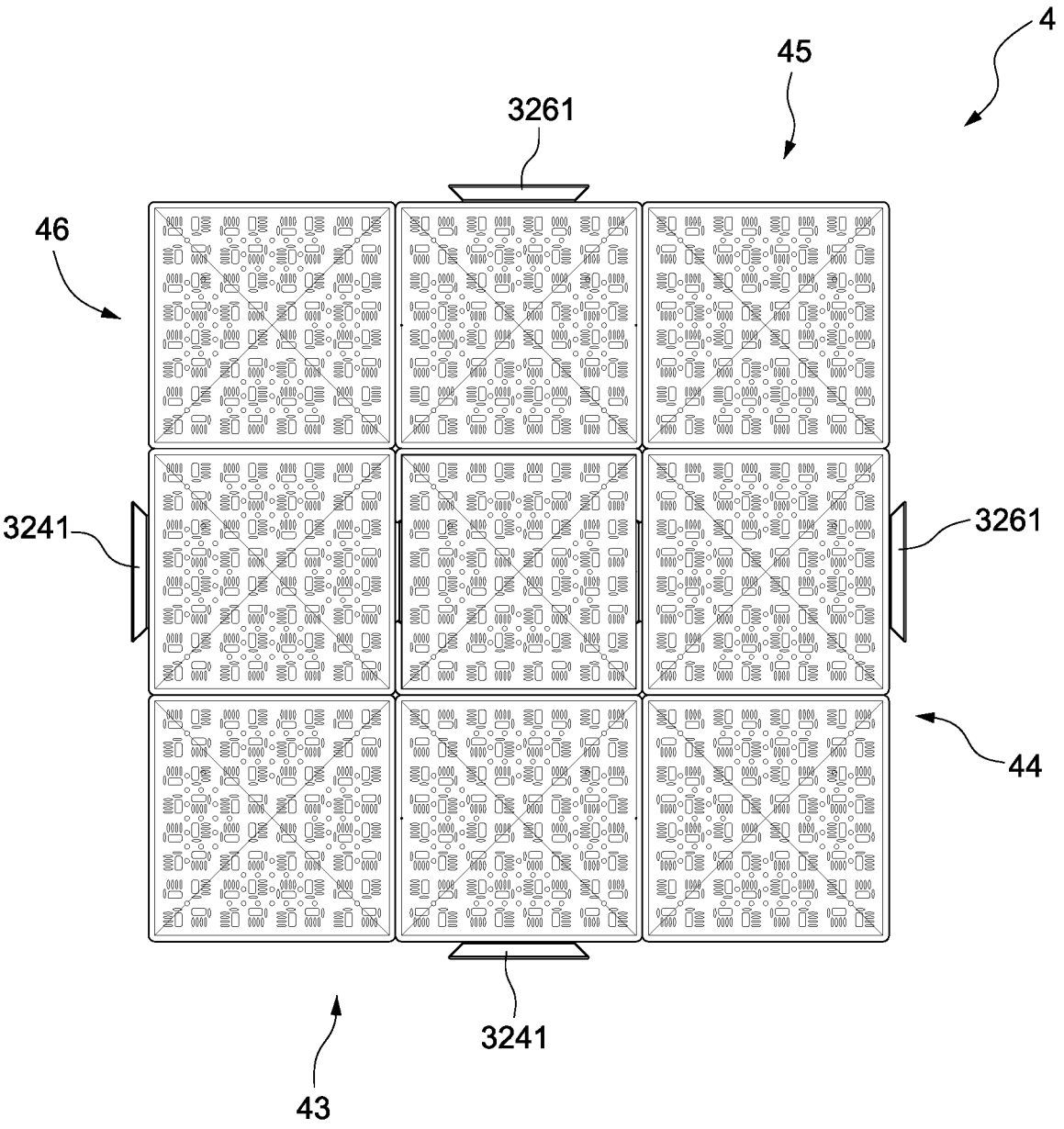
FIG. 6A is a top view of the unit assembled brick shown in FIG. 6.

Due to the third linkage brick 33, users may assemble four first linkage bricks 31 and four second linkage bricks 32 first and then use a third linkage brick 33 to engage with the second linkage bricks 32 through sliding the third linkage brick 33 from the top to the bottom to form a unit assembled brick 4 as shown in FIGS. 6 and 6A.

In detail, a user may engage four first linkage bricks 31 with four second linkage bricks 32 alternately so that the adjacent traverse engaging grooves 3131, 3141, 3151, 3161 of the first linkage bricks 31 engage with the adjacent traverse engaging protrusions 3231, 3251 of the second linkage bricks to form a hollow square ring arranged in a 3×3 array. The inner sides of the square ring have four vertical engaging protrusions 3241, 3261 of the second linkage bricks 32. Then, through downward sliding, the user places a third linkage brick 33 in the center of the hollow square ring and respectively engages each of the four vertical engaging grooves 3331, 3341, 3351, 3361 of the third linkage brick 33 with each of the four vertical engaging protrusions 3241, 3261 of the second linkage bricks 32, which face the inner sides of the square ring, and engages the wedged corners 32E of each of the vertical engaging protrusions 3241, 3261 of the second linkage bricks 32 with the wedged grooved portions 33E of each of the vertical engaging grooves 3331, 3341, 3351, 3361 of the third linkage brick 33 so as to form a unit assembled brick 4.

As shown in FIGS. 6 and 6A, the unit assembled brick 4 respectively defines a top face 41, a bottom face 42 and four side faces 43, 44, 45, 46 between the top face 41 and the bottom face 42. Each of the side faces forms a traverse engaging groove 3131, 3141, 3151, 3161, a vertical engaging protrusion 3241, 3261, 3261, 3241 and a traverse engaging groove 3131, 3141, 3151, 3161 sequentially.

Referring to the unit assembled brick 4 of the subject invention shown in FIGS. 6 and 6A, the unit assembled brick is defined as a fundamental unit of the linkage brick assembly 3 formed by the assembly of the linkage bricks 31, 32, 33. Taking the weight of linkage bricks per unit area into consideration, since the more sides the shape of a linkage brick has (e.g., pentagon, hexagon or shapes with more sides and so on), the more linkage bricks adjacent thereto are required to be engaged therewith, it is preferable that the linkage bricks of similar sizes have fewer sides (e.g., quadrilateral) so that fewer linkage bricks to be engaged therewith are required.

As shown in FIGS. 5, 5A, 5B, 5C and 5D, the linkage brick assembly 3 of the subject invention further comprises at least one fourth linkage brick 34 which comprises a top face 341, a bottom face 342 and four side faces 343, 344, 345, 346 between the top face 341 and the lower surface 342. Each of two opposite side faces 343, 345 of the side faces forms a traverse engaging protrusion 3431, 3451 extending substantially horizontally and another side face 344 of the side faces 344, 346 forms a vertical engaging protrusion 3441 extending vertically.

In the embodiments of the subject invention, each of the traverse engaging grooves 3131, 3141, 3151, 3161 of the first linkage brick 31 is used to engage with each of the traverse engaging protrusions 3431, 3451 of the fourth linkage brick 34 through lateral sliding. Each of the vertical engaging grooves 3331, 3341, 3351, 3361 of the third linkage brick 33 is used to engage with the vertical engaging protrusion 3441 of the fourth linkage brick 34 through downward sliding in the vertical direction.

Figure 5:
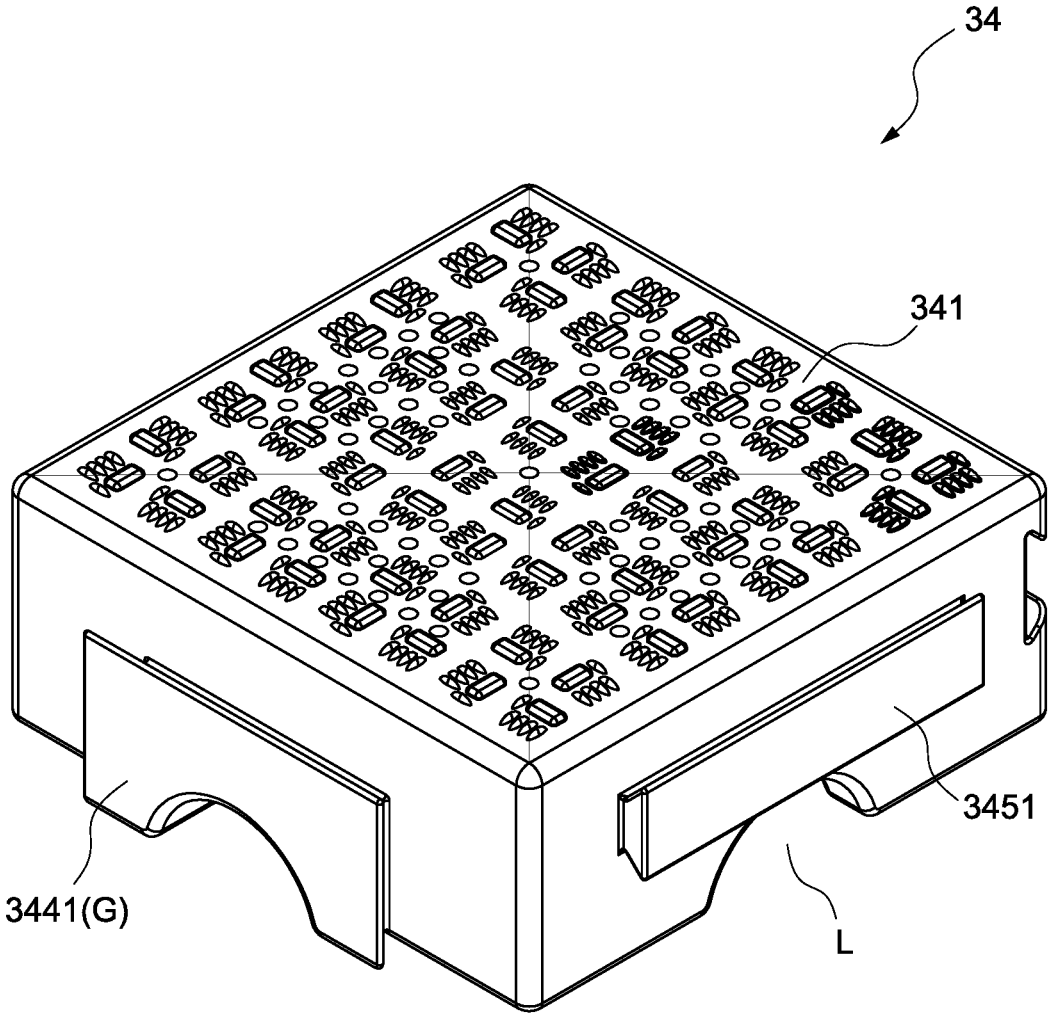
FIG. 5 is a perspective view of a fourth linkage brick of the linkage brick assembly in accordance with the first embodiment of the subject invention.
Figure 5A:
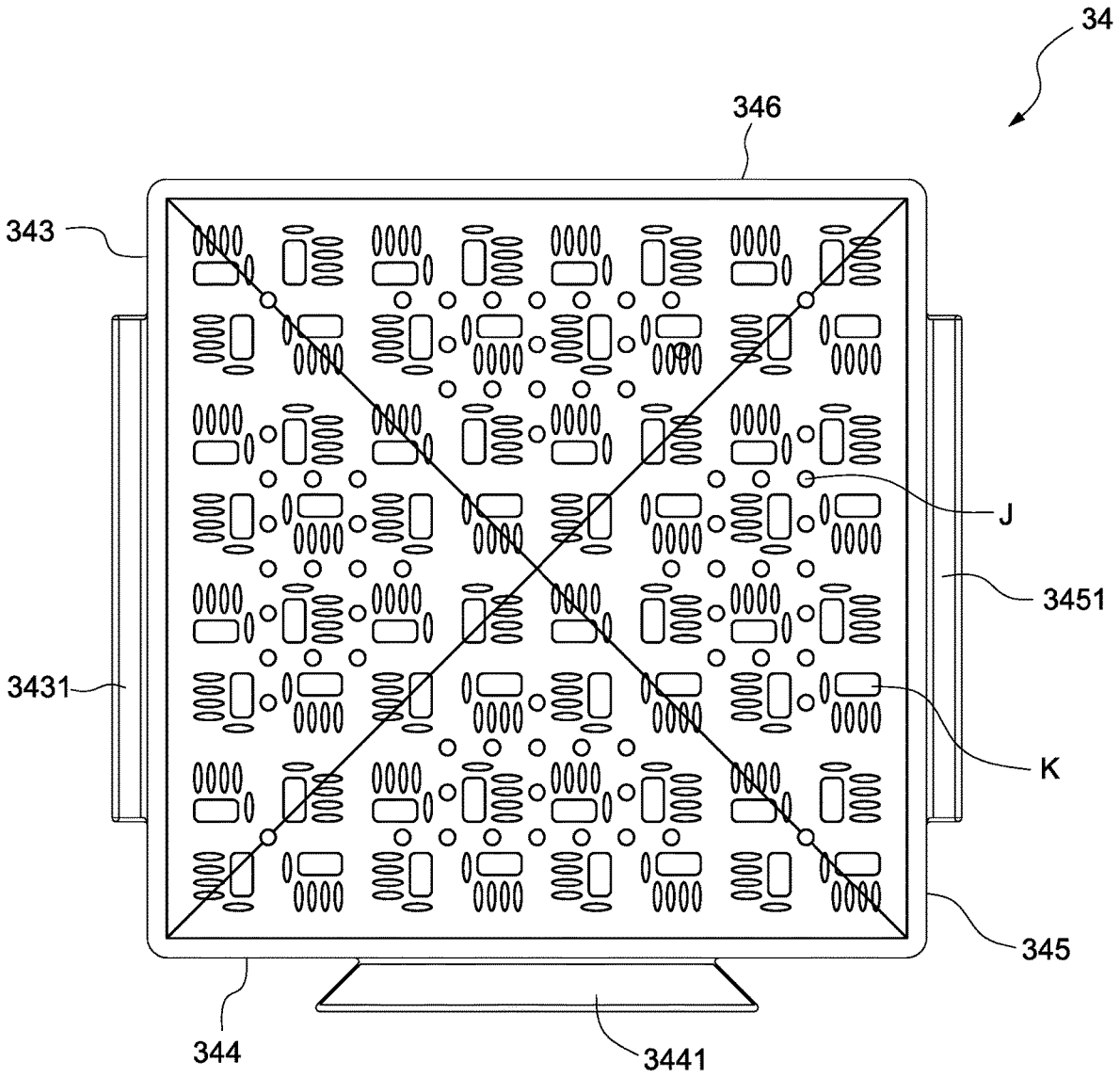
FIG. 5A is a top view of the fourth linkage brick shown in FIG. 5.
Figure 5B:
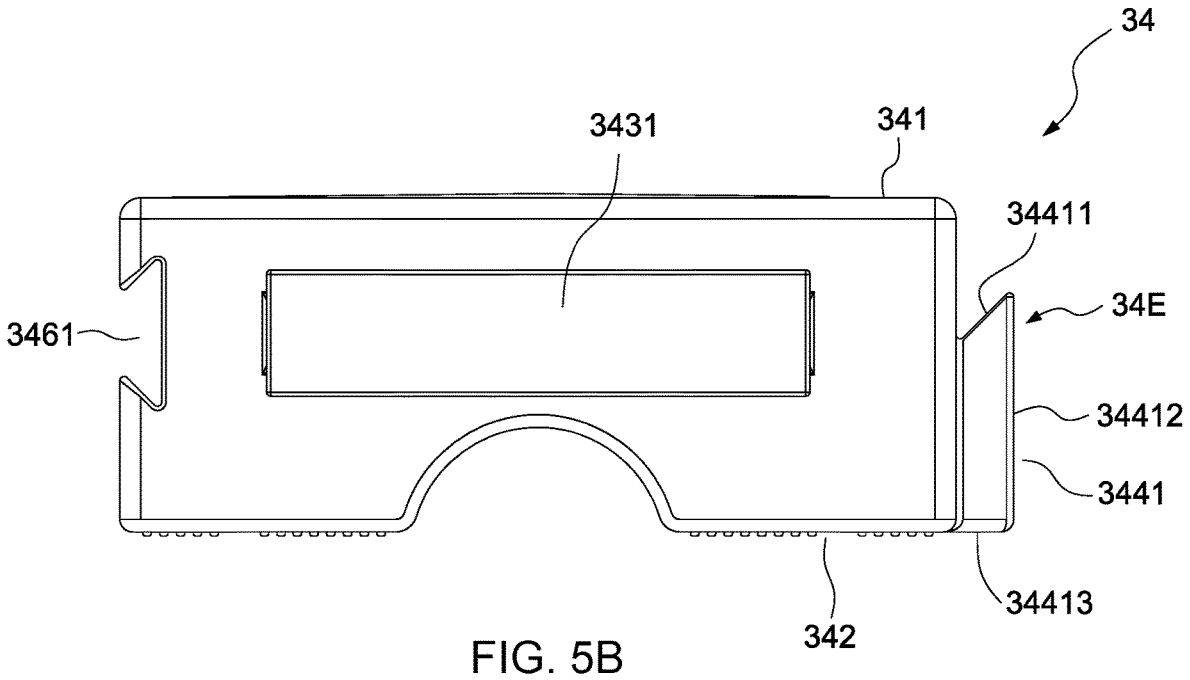
FIG. 5B is a side view illustrating a side face of the fourth linkage brick shown in FIG. 5.
Figure 5C:
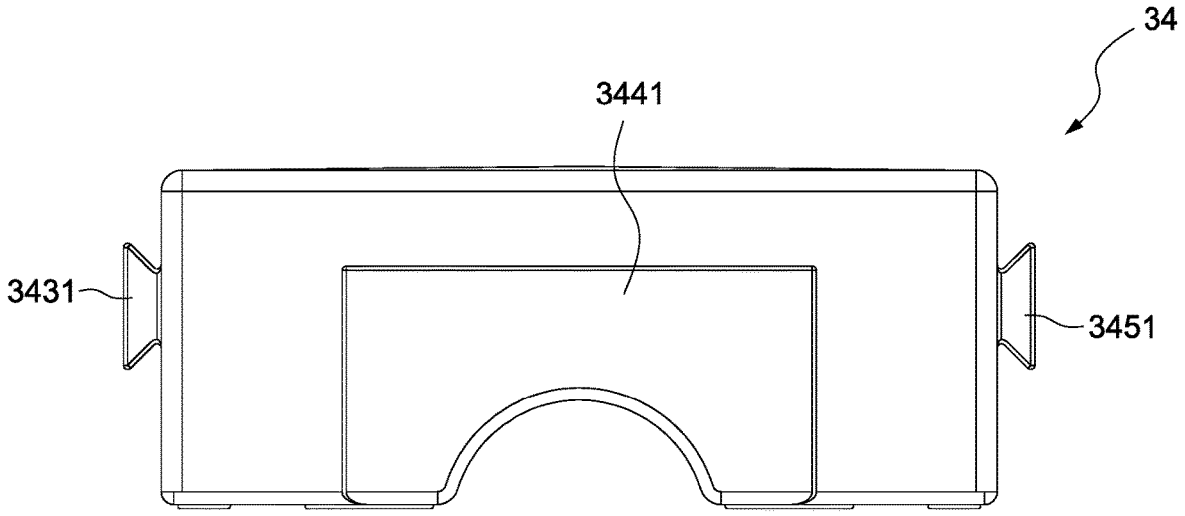
FIG. 5C is a side view illustrating one of the other two opposite side faces of the fourth linkage brick shown in FIG. 5.
Figure 5D:
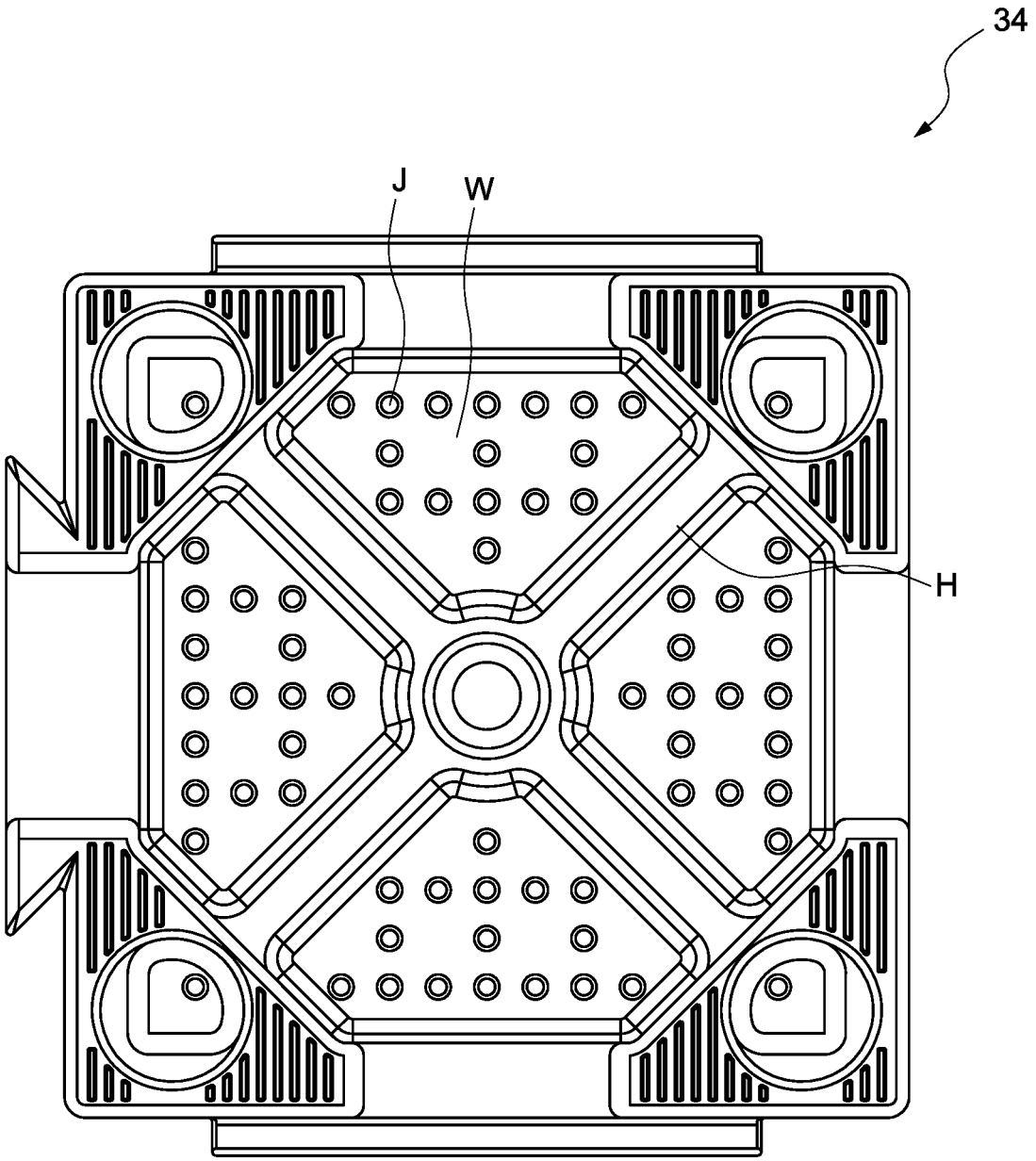
FIG. 5D is a bottom view of the fourth linkage brick shown in FIG. 5.

In addition, as shown in FIG. 5B, a top face 34411 (closest to the top face 341 of the fourth linkage brick 34) of the vertical engaging protrusion 3441 of the fourth linkage brick 34 is slanted and defines, together with an outer side face 34412 of the vertical engaging protrusion 3441, a wedged corner 34E. The wedged corner 34E of the vertical engaging protrusion 3441 of the fourth linkage brick 34 is used to engage with the wedged grooved portion 33E of each of the vertical engaging grooves 3331, 3341, 3351, 3361. Further, the vertical engaging protrusion 3441 of the fourth linkage brick 34 does not extend to the top face 341 of the fourth linkage brick 34.

In this embodiment, the side face 346 opposite to the vertical engaging protrusion 3441 of the fourth linkage brick 34 forms a traverse engaging groove 3461 extending laterally. The traverse engaging groove 3461 of the fourth linkage brick 34 is used to engage with each of the traverse engaging protrusions 3231, 3251 of the second linkage brick 32 through lateral sliding. The traverse engaging groove 3461 extends substantially horizontally.

In other possible embodiments, the vertical engaging protrusion 3431, 3451 of the fourth linkage brick 34 is configured to gradually enlarge outwardly from the corresponding side face 343, 345 and protrude to form a configuration such as a truncated triangular prism or a truncated triangular pyramid.

In other possible embodiments, it is also possible for the side face 346 opposite to the vertical engaging protrusion 3441 of the fourth linkage brick 34 to not comprise the traverse engaging groove 3461 or any groove of other configurations.

As shown in FIG. 1, when a large area of the structure of the linkage brick assembly 3 of the subject invention is desired, the process mentioned above may be repeated to form a plurality of the unit assembled bricks 4. The plurality of the unit assembled bricks 4 are then aligned and paved on the ground and additional second linkage bricks 32 and additional third linkage bricks 33 are alternately placed between the adjacent unit assembled bricks 4. Further, the traverse engaging protrusion 3231, 3251 of the additional second linkage brick 32 engages with the corresponding traverse engaging groove 3131, 3141, 3151, 3161 of the adjacent unit assembled brick 4 through lateral sliding and then the vertical engaging groove 3331, 3341, 3351, 3361 of the additional third linkage brick 33 engages with the corresponding vertical engaging protrusion 3241, 3261 of the adjacent unit assembled bricks 4 and the adjacent second linkage bricks 32 through downward sliding to accomplish the assembly of the desired linkage brick assembly 3.

The convenience and high efficiency of the assembly of the linkage brick assembly mentioned above are mainly attributed to the downward engagement of the vertical engaging grooves 3331, 3341, 3351, 3361 of the third linkage brick 33 with the vertical engaging protrusions 3241, 3261 of the second linkage brick 32.

Due to the engaging structure of the subject invention which includes vertical downward sliding and lateral sliding, the assembly of the linkage brick assembly of the subject invention may be able to proceed at multiple points on the ground to be paved simultaneously and thus the subject invention has an effect of quick assembly.

Additionally, since the third linkage brick 33 is engaged in a manner of downward sliding, when an error occurs during the assembly process of the linkage brick assembly, the third linkage brick 33 is allowed to be lifted so that certain portion(s) of area of the linkage brick assembly can be disassembled without disassembling all portions of the linkage brick assembly which have been accomplished.

Furthermore, when the linkage brick assembly is to be disassembled, the technical features mentioned above can allow the disassembly work to be done at multiple locations simultaneously, thereby enhancing the efficiency of the disassembly.

However, as shown in FIG. 1, the outermost periphery of the linkage brick assembly 3 accomplished in the above way will have the vertical engaging protrusions 3241 of the second linkage bricks 32, which causes the periphery of the linkage brick assembly 3 to be uneven. To avoid such phenomenon, a few fourth linkage bricks 34 may be substituted for the second linkage bricks 32 located on the outer rim of the linkage brick assembly 3. Through lateral sliding, the traverse engaging grooves 3131, 3141, 3151, 3161 of the adjacent first linkage bricks 1 engage with the traverse engaging protrusions 3431, 3451 of the fourth linkage bricks 32 respectively. Through downward sliding, the vertical engaging recesses 3331, 3341, 3351, 3361 of the adjacent third linkage bricks 33 engage with the vertical engaging protrusions 3441 of the fourth linkage bricks 32 respectively. In addition, the wedged corners 34E of the vertical engaging protrusions 3441 of the fourth linkage bricks 34 engage with the wedged grooved portions 33E of the vertical engaging grooves 3331, 3341, 3351, 3361 of the adjacent third linkage bricks 33.

Figure 7:
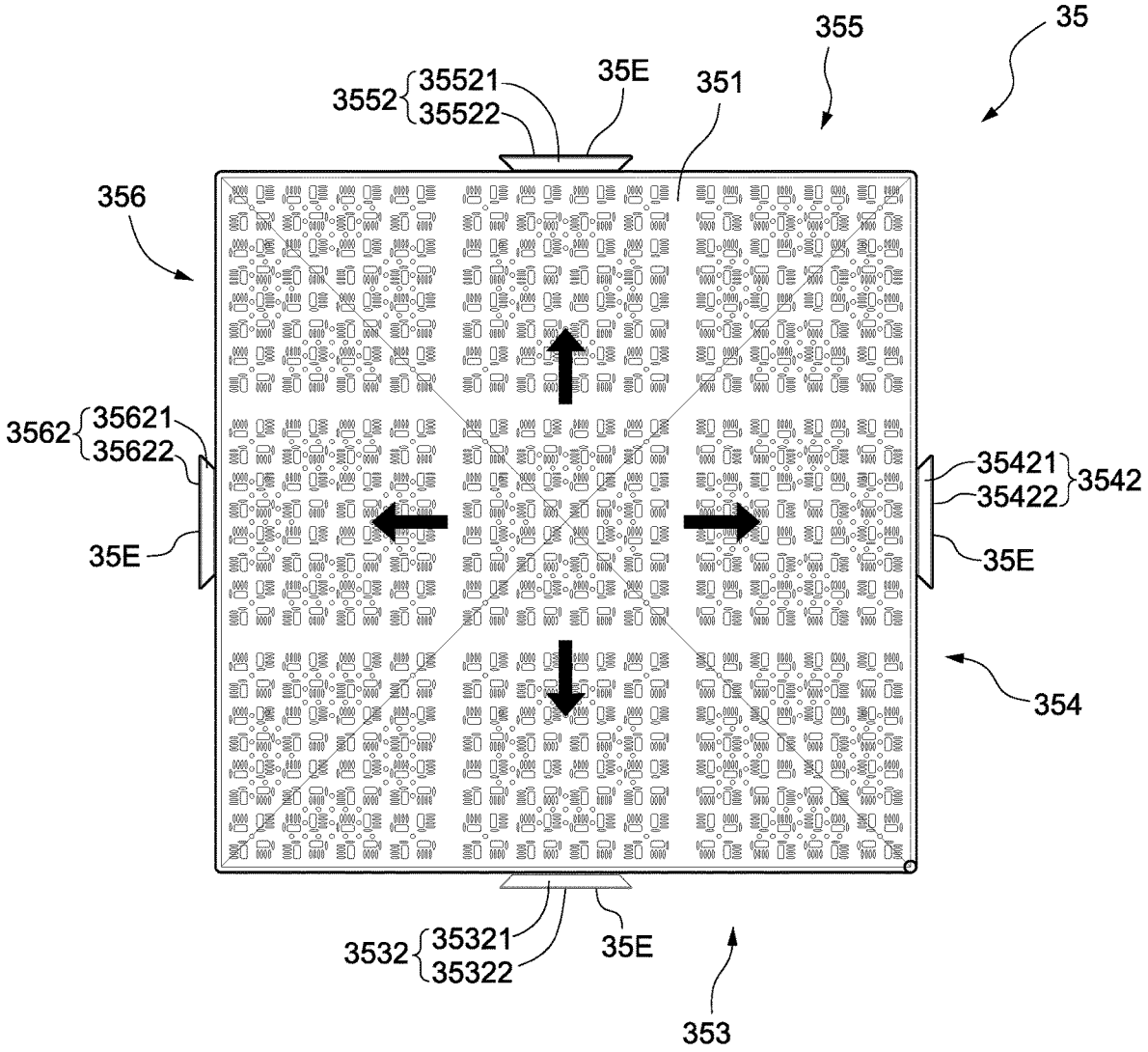
FIG. 7 is a top view of a unit linkage brick of a linkage brick assembly in accordance with a second embodiment of the subject invention.
Figure 7A:
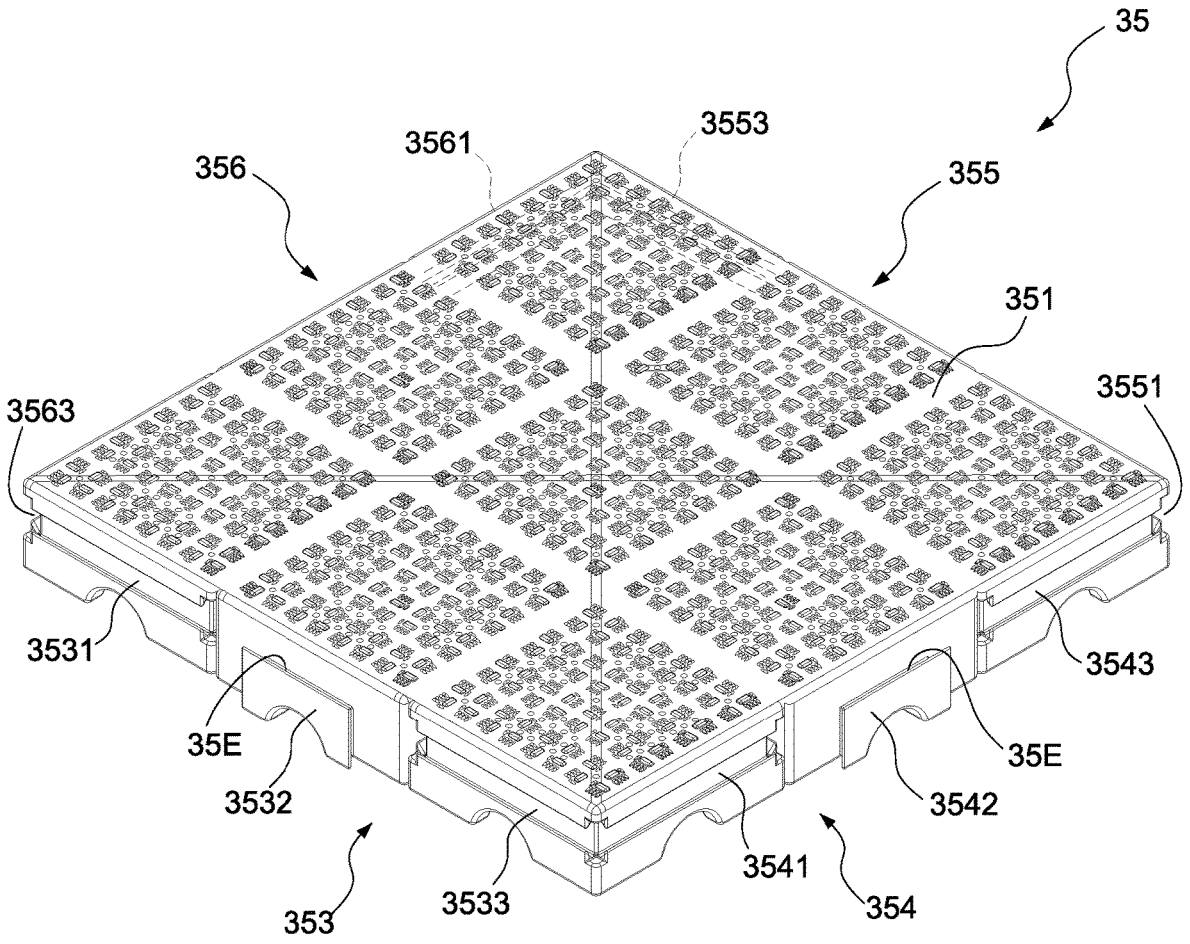
FIG. 7A is a perspective view of the unit linkage brick shown in FIG. 7.

In the second embodiment of the subject invention, the linkage brick assembly 3 further comprises at least one unit linkage brick 35 as illustrated in FIG. 7. The unit linkage brick 35 comprises a top face 351, a bottom face 352 and four side faces 353, 354, 355, 356 between the top face 351 and the bottom face 352. Each of the side faces forms a traverse engaging groove 3531, 3541, 3551, 3561, a vertical engaging protrusion 3532, 3542, 3552, 3562 and a traverse engaging groove 3533, 3543, 3553, 3563 sequentially. The linkage brick assembly 3 is preferably made integrally.

Each of the traverse engaging grooves 3531, 3541, 3551, 3561 of the unit linkage brick 35 is used to engage with each of the traverse engaging protrusions 3231, 3251 of the second linkage brick 32 through lateral sliding. In addition, each of the vertical engaging grooves 3331, 3341, 3351, 3361 of the third linkage brick 33 is used to engage with each of the vertical engaging protrusions 3532, 3542, 3552, 3562 of the unit linkage brick 35 through downward sliding.

Similar to the second linkage brick 32 and the fourth linkage brick 34, a top face 35321, 35421, 35521, 35621 and an outer side face 35322, 35422, 35522, 35622 of each of the vertical engaging protrusions 3532, 3542, 3552, 3562 of the unit linkage brick 35 define a wedged corner 35E. The wedged corner 35E of each of the vertical engaging protrusions 3532, 3542, 3552, 3562 of the unit linkage brick 35 is used to engage with the wedged grooved portion 33E of each of the vertical engaging grooves 3331, 3341, 3351, 3361 of the third linkage brick 33. Preferably, each of the vertical engaging grooves 3331, 3341, 3351, 3361 mentioned above downwardly engages with each of the vertical engaging protrusions 3532, 3542, 3552, 3562 in the vertical direction. In addition, each of the vertical engaging protrusions 3532, 3542, 3552, 3562 of the unit linkage brick 35 does not extend to the top face 351 of the unit linkage brick 35.

When it is desired to use a few unit linkage bricks 35 to obtain a linkage brick assembly 3' of the subject invention which has a large area, in the same way, a plurality of unit linkage bricks 35 may be paved on the ground in a substantially aligned manner, and the second linkage bricks 32 and the third linkage bricks 33 are alternately placed between the adjacent unit linkage bricks 35. Then the traverse engaging protrusion 3231, 3251 of the second linkage brick 32 engages with the corresponding traverse engaging groove 3531, 3541, 3551, 3561, 3533, 3543, 3553, 3563 of the adjacent unit linkage brick 35 through lateral sliding, and the vertical engaging groove 3331, 3341, 3351, 3361 of the unit linkage brick 35 engages with the corresponding vertical engaging protrusion 3532, 3542, 3552, 3562 of the adjacent unit linkage bricks 35 and the corresponding vertical engaging protrusion 3241, 3261 of the adjacent second linkage bricks 32 through downward sliding to accomplish the assembly of the desired linkage brick assembly 3'.

Referring to FIGS. 3 and 5, in the preferable embodiments of the subject invention, the vertical engaging protrusions 3241, 3261, 3441, 3532, 3542, 3552, 3562 of the linkage bricks 32, 34, 35 are a plurality of dovetail protrusions G extending vertically. Referring to FIG. 4, the vertical engaging grooves 3331, 3341, 3351, 3361 of the third linkage brick 33 are a plurality of dovetail grooves G' extending vertically.

In other possible embodiments, the vertical engaging protrusions 3241, 3261, 3441, 3535, 3542, 3552, 3562 may also be configured to gradually enlarge outwardly from the corresponding side face so as to form a configuration of, for example, a truncated triangular prism or a truncated triangular pyramid. The vertical engaging grooves 3331, 3341, 3351, 3361 may also be configured to gradually contract inwardly from the corresponding side face so as to be suitable to engage with the vertical engaging protrusions 3241, 3261, 3441, 3532, 3542, 3552, 3562.

Referring to FIGS. 2C, 3D, 4D and 5D, in a preferable embodiment, the bottom face 312, 322, 332, 342, 352 of each of the linkage bricks 31, 32, 33, 34, 35 forms a plurality of support ribs H extending downwardly. Referring to the diagonal cross-sectional view FIG. 2D of the linkage brick 32 of the subject invention, the support rib H of the linkage bricks 31, 32, 33, 34, 35 in a preferable embodiment is arched.

It is noteworthy that since the support rib H in the preferable embodiment of the subject invention is arched, it can provide the linkage bricks with better support and increase the strength of the linkage bricks.

Further referring to FIGS. 15-18, in more preferable embodiments, the plurality of support ribs H' of the linkage bricks 31, 32, 33, 34 extend downwardly to the bottom faces 312, 322, 332, 342 so that they are flush with the bottom faces 312, 322, 332, 342. The structure of said support rib H' can enhance the rigidity of the linkage bricks as well as allow the force applied on the linkage bricks 31, 32, 33, 34 to be evenly distributed to the ground and therefore provides the linkage bricks with better capability for support and stability.

In other possible embodiments, the plurality of support ribs H extends from each corner of the bottom faces 312, 322, 332, 342, 352 of the linkage bricks to the center thereof, and may also extend continuously from a corner to the opposite corner of the bottom faces 312, 322, 332, 342, 352.

Figure 2:
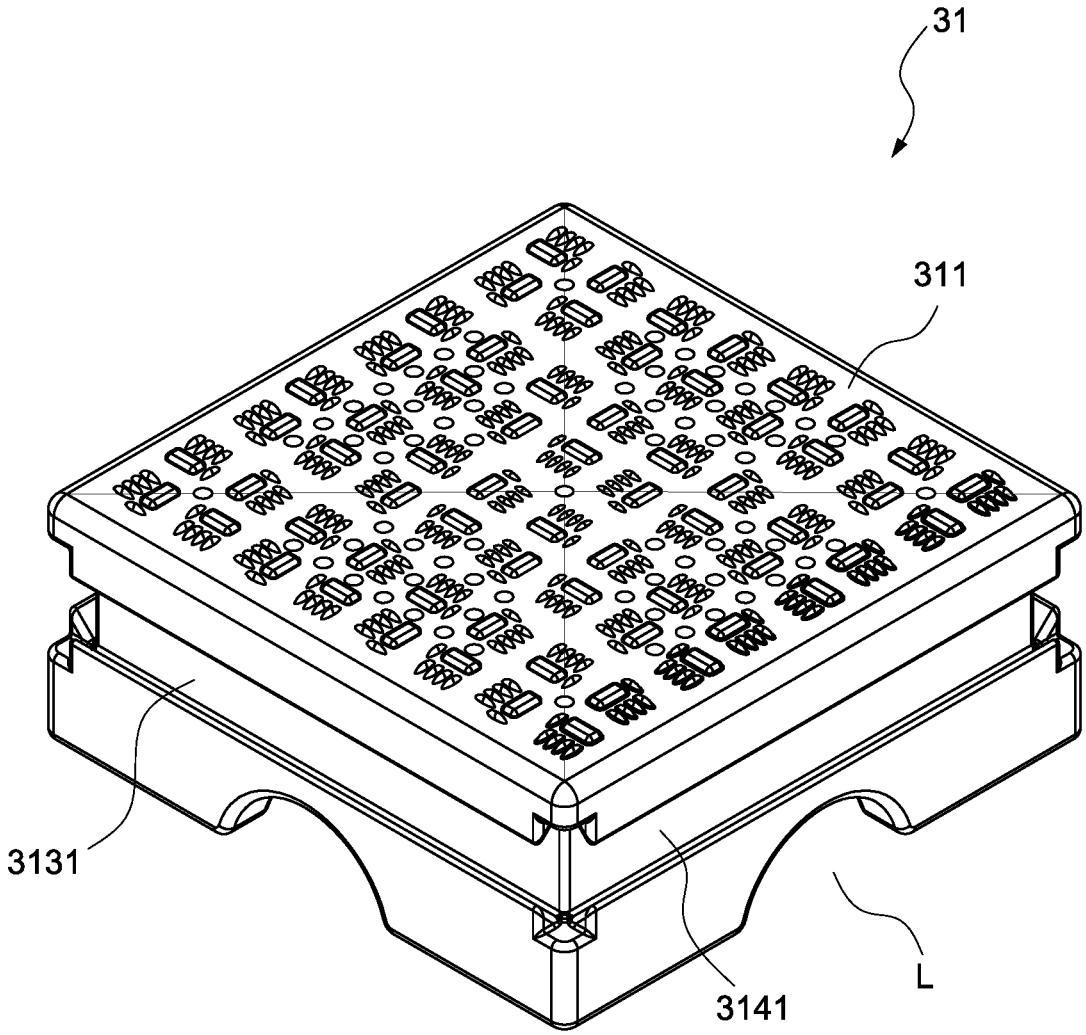
FIG. 2 is a perspective view of a first linkage brick of the linkage brick assembly in accordance with the first embodiment of the subject invention.
Figure 2A:
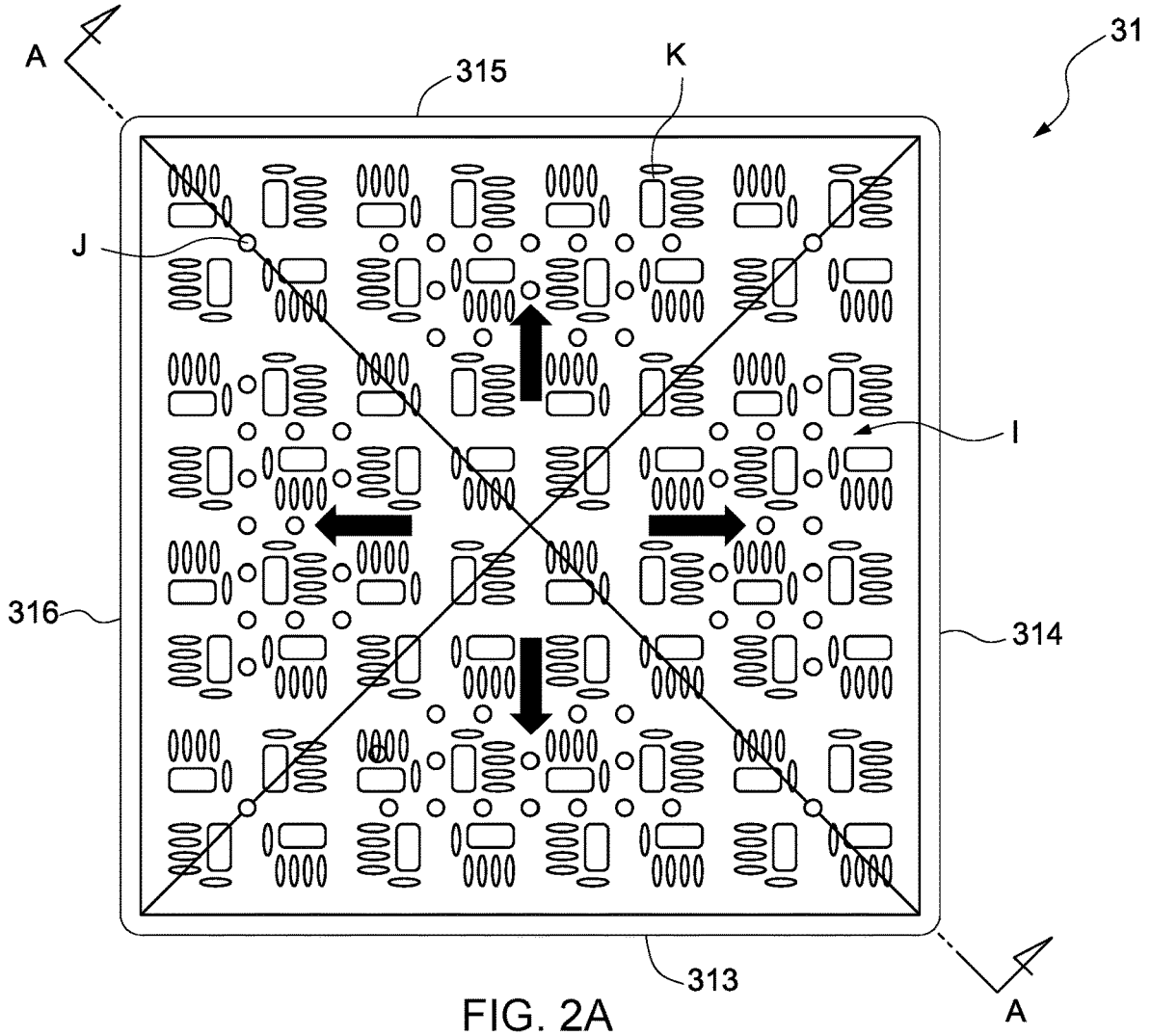
FIG. 2A is a top view of the first linkage brick shown in FIG. 2.
Figure 2B:
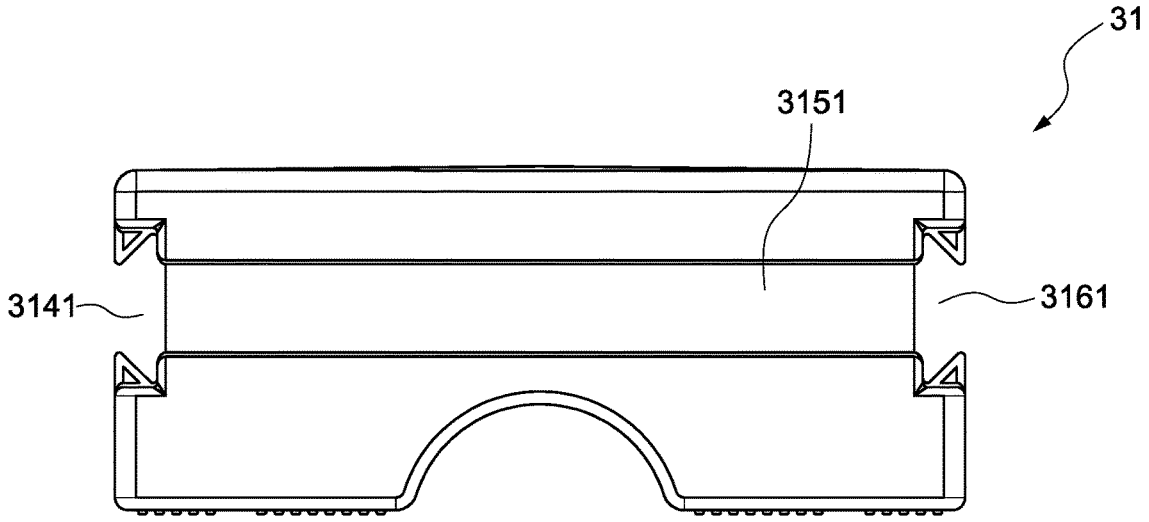
FIG. 2B is a side view illustrating one of the four side faces of the first linkage brick shown in FIG. 2.
Figure 2C:
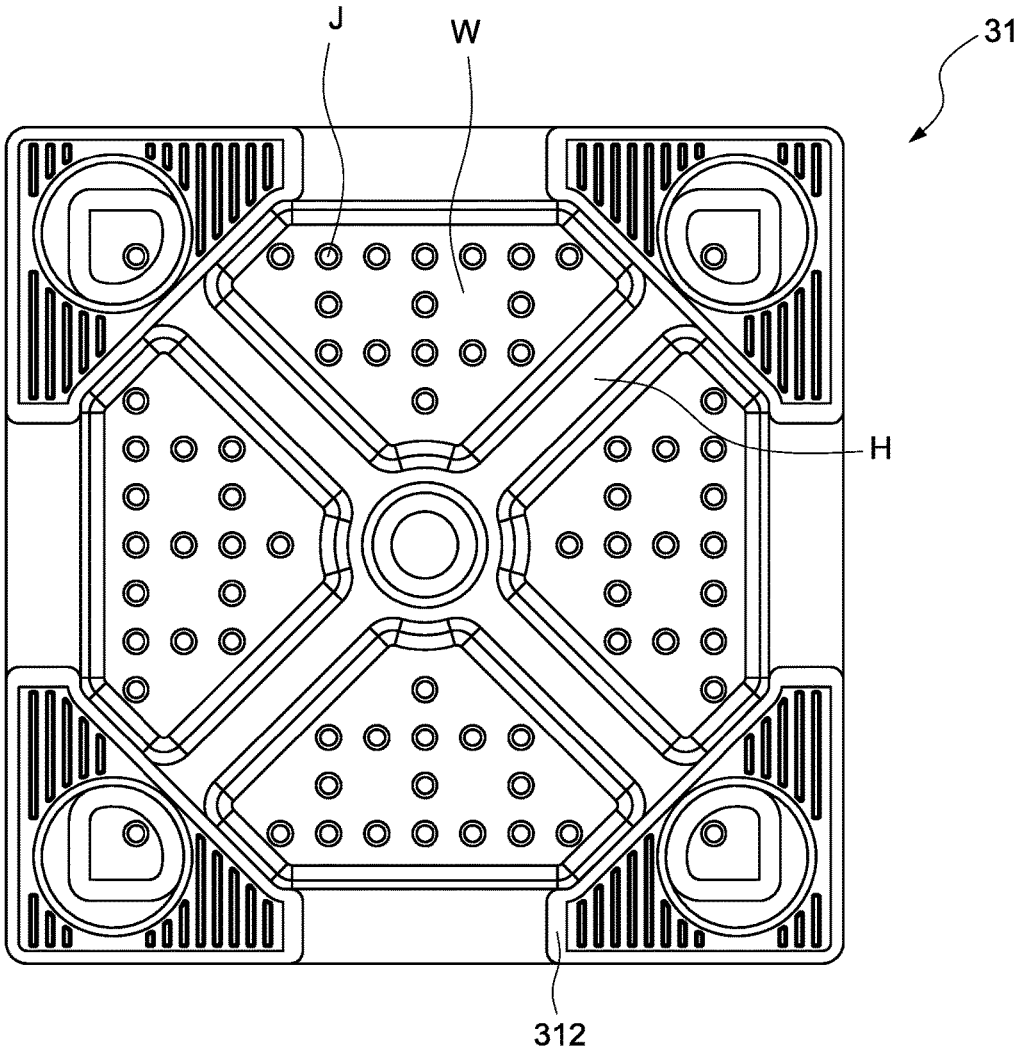
FIG. 2C is a bottom view of the first linkage brick shown in FIG. 2.
Figure 2D:
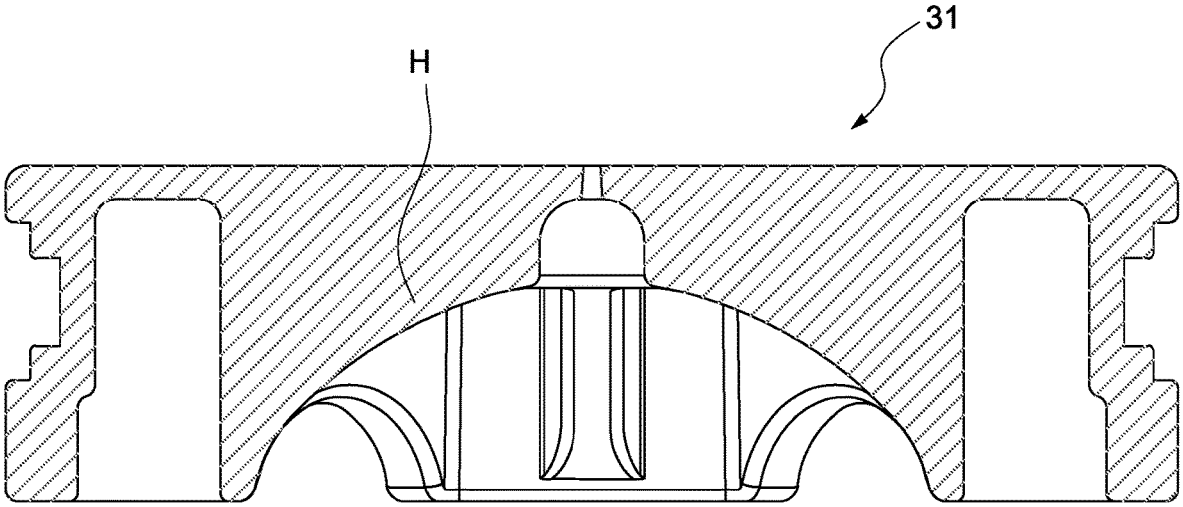
FIG. 2D is a diagonal cross-sectional view of the first linkage brick along Line A-A of FIG. 2A.
Figure 8:
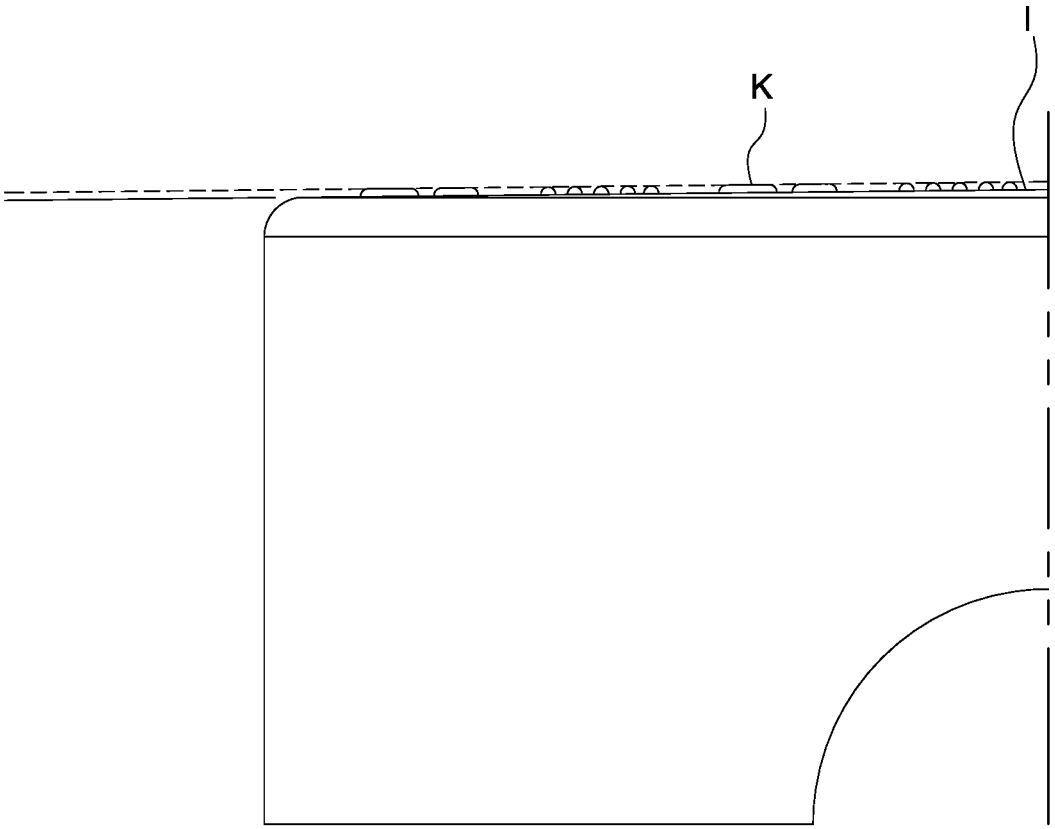
FIG. 8 is a side view illustrating slip-resistant patterns of a portion of a linkage brick of the subject invention.

Referring to FIG. 2A, in a preferable embodiment, the top face 311, 321, 331, 341, 351 of each of the linkage bricks 31, 32, 33, 34, 35 respectively forms a plurality of drainage slopes I slanting from the center of the top face 311, 321, 331, 341, 351 downwardly and outwardly (in the direction indicated by the arrow shown in FIG. 2A). As shown in FIG. 8, the drainage slopes I have a drainage gradient and when it rains, the drainage slopes I can urge the rain to quickly flow to the rims of the top face of the linkage brick 31, 32, 33, 34, 35 and achieve the effect of facilitating drainage.

In a preferable embodiment of the subject invention, the drainage slope I may be each of the four triangles defined by the diagonals of the top face of the linkage bricks. Each of the triangles is configured to form an apex at the center of the top face of the linkage brick and tilts downward and outward in the direction indicated by the arrow in FIG. 2A.

In the drawings, the diagonals on the top face 311, 321, 331, 341, 351 of each linkage brick show the arris of the intersection of each drainage slope I, which is intended to illustrate a form of the drainage slope I in a preferable embodiment of the subject invention but should not be a limit to the structure of the linkage brick of the subject invention. That is, the top face of the linkage brick of the subject invention may also be the drainage slopes of other forms that can fulfill the purpose of enhancing water drainage.

Referring to FIGS. 2-7, in a preferable embodiment, each of the linkage bricks 31, 32, 33, 34, 35 respectively forms a plurality of drainage holes J penetrating through the linkage bricks from the top face to the bottom face thereof. The drainage holes J may have different shapes, for example, circle, rectangle, triangle, polygon. In other possible embodiments, the area through which the drainage holes J penetrate on the outer surface of the top face of the linkage bricks is preferably smaller (also likely to be larger) than the area through which the drainage holes J penetrate on the inner surface of that top face.

Still referring to FIGS. 2-7, the top face 311, 321, 331, 341, 351 of each of the linkage bricks 31, 32, 33, 34, 35 forms a plurality of slip-resistant patterns K.

FIG. 8 illustrates a side view of a portion of a linkage brick having slip-resistant patterns K, wherein the slip-resistant patterns K have at least a height on the top face of the linkage brick as shown by broken lines. However, in other possible embodiments, the slip-resistant patterns K may also be patterns with a depth extending downwardly from the top face.

Figure 8A:
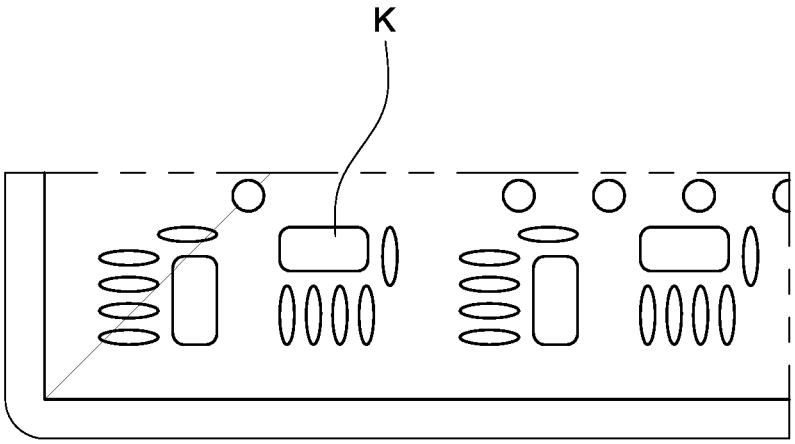
FIG. 8A illustrates an enlarged view illustrating the slip-resistant patterns of the portion of the linkage brick of the subject invention.
Figure 9:
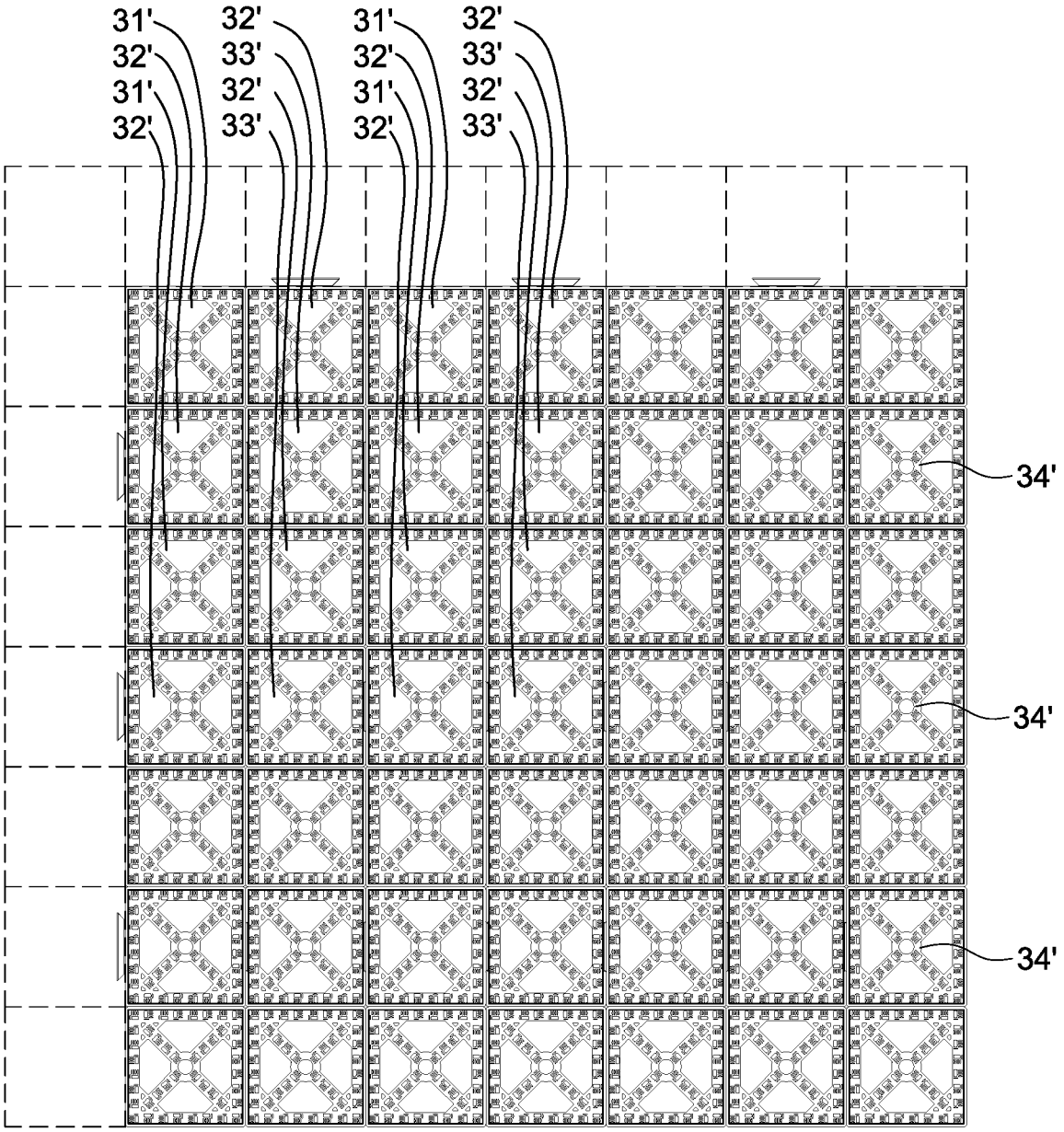
FIG. 9 illustrates the linkage brick assembly with a plurality of planting holes of the subject invention.
Figure 10:
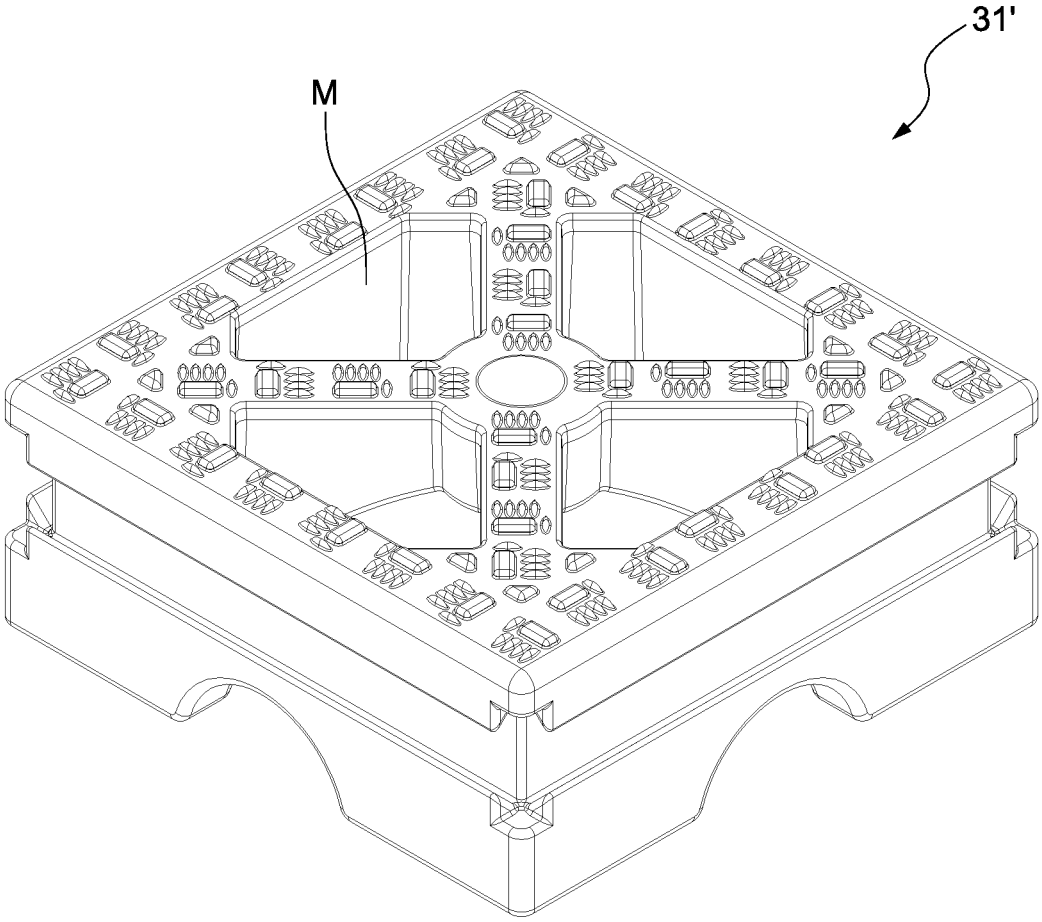
FIG. 10 illustrates the first linkage brick with a plurality of planting holes of the subject invention.
Figure 11:
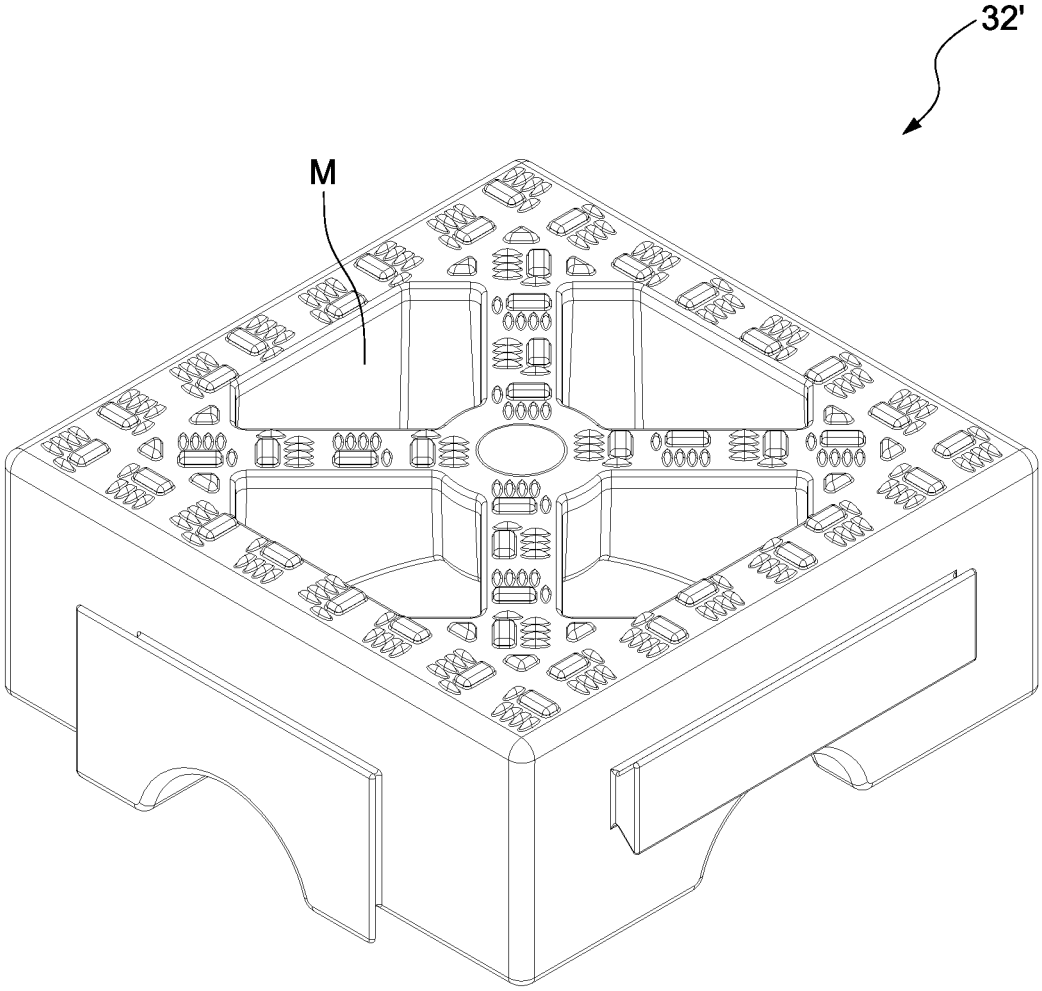
FIG. 11 illustrates the second linkage brick with a plurality of planting holes of the subject invention.
Figure 12:
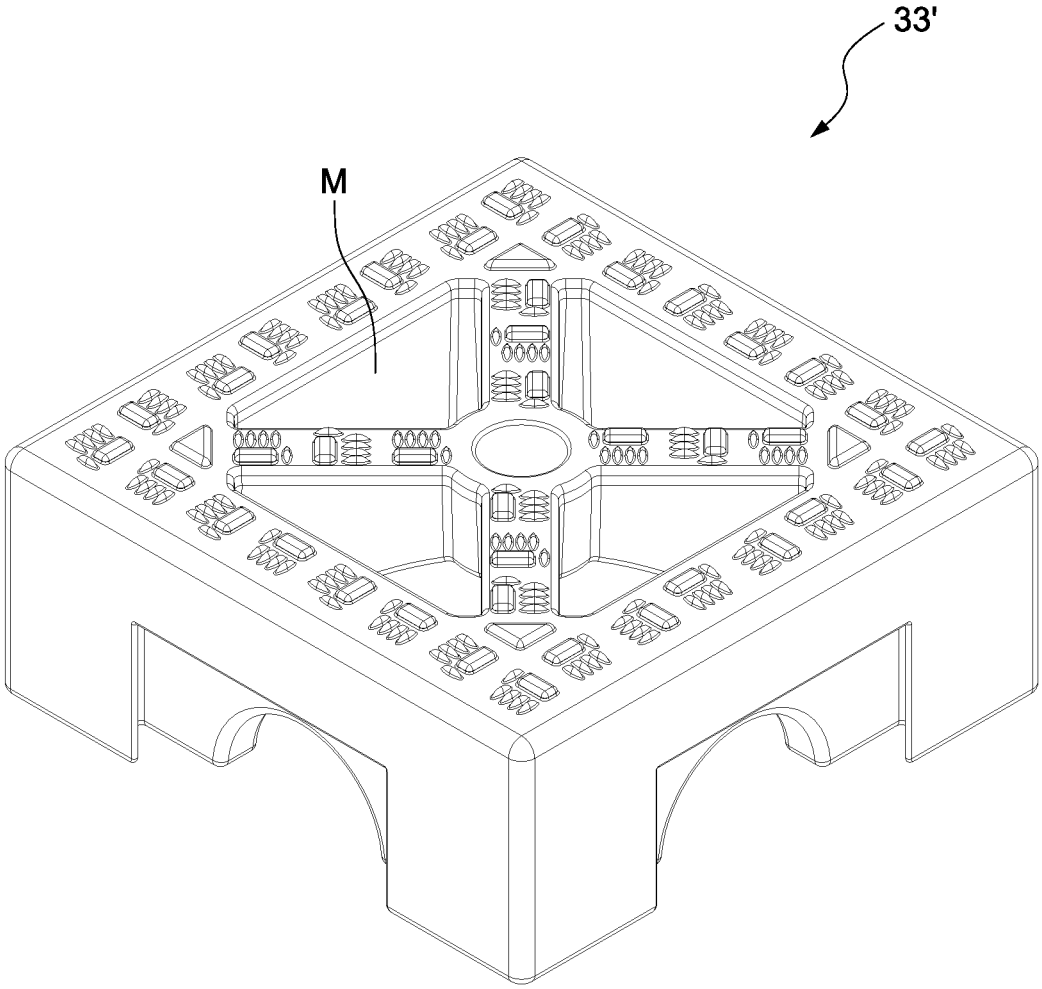
FIG. 12 illustrates the third linkage brick with a plurality of planting holes of the subject invention.
Figure 13:
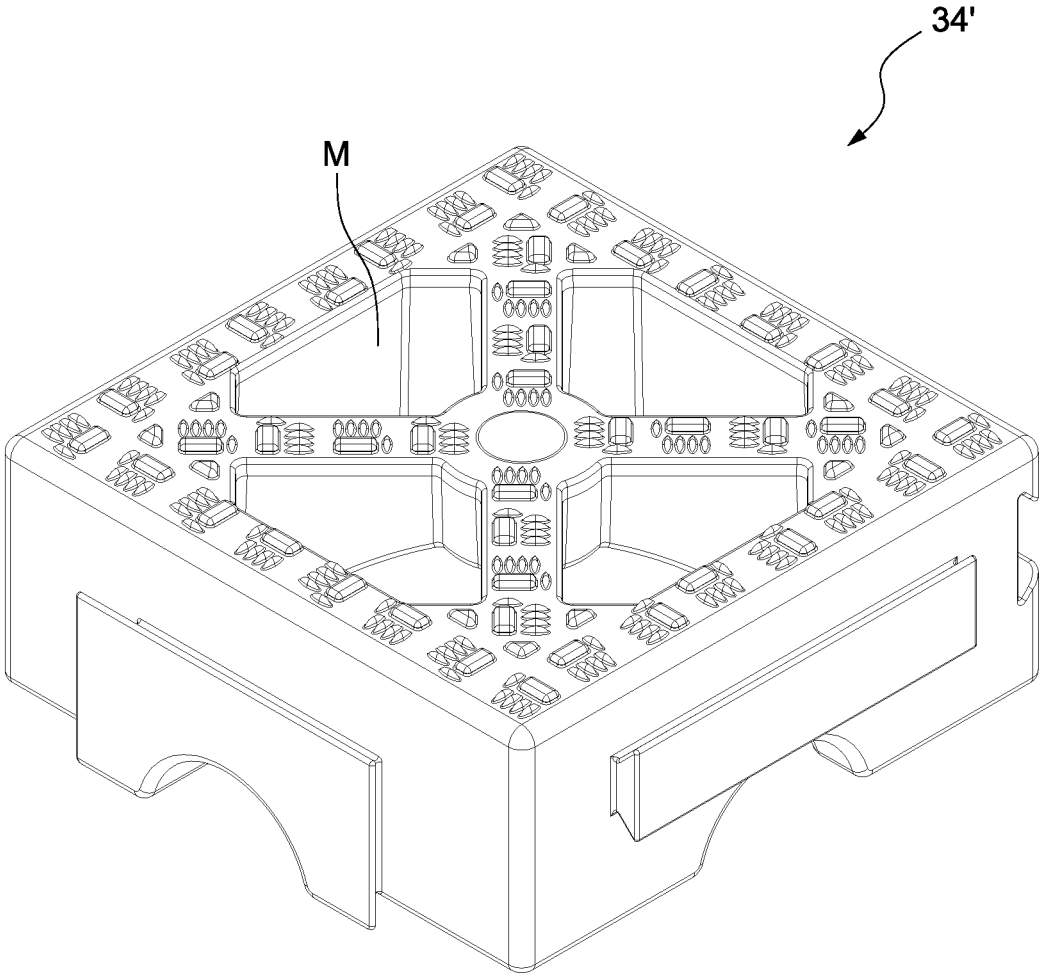
FIG. 13 illustrates the fourth linkage brick with a plurality of planting holes of the subject invention.
Figure 14:
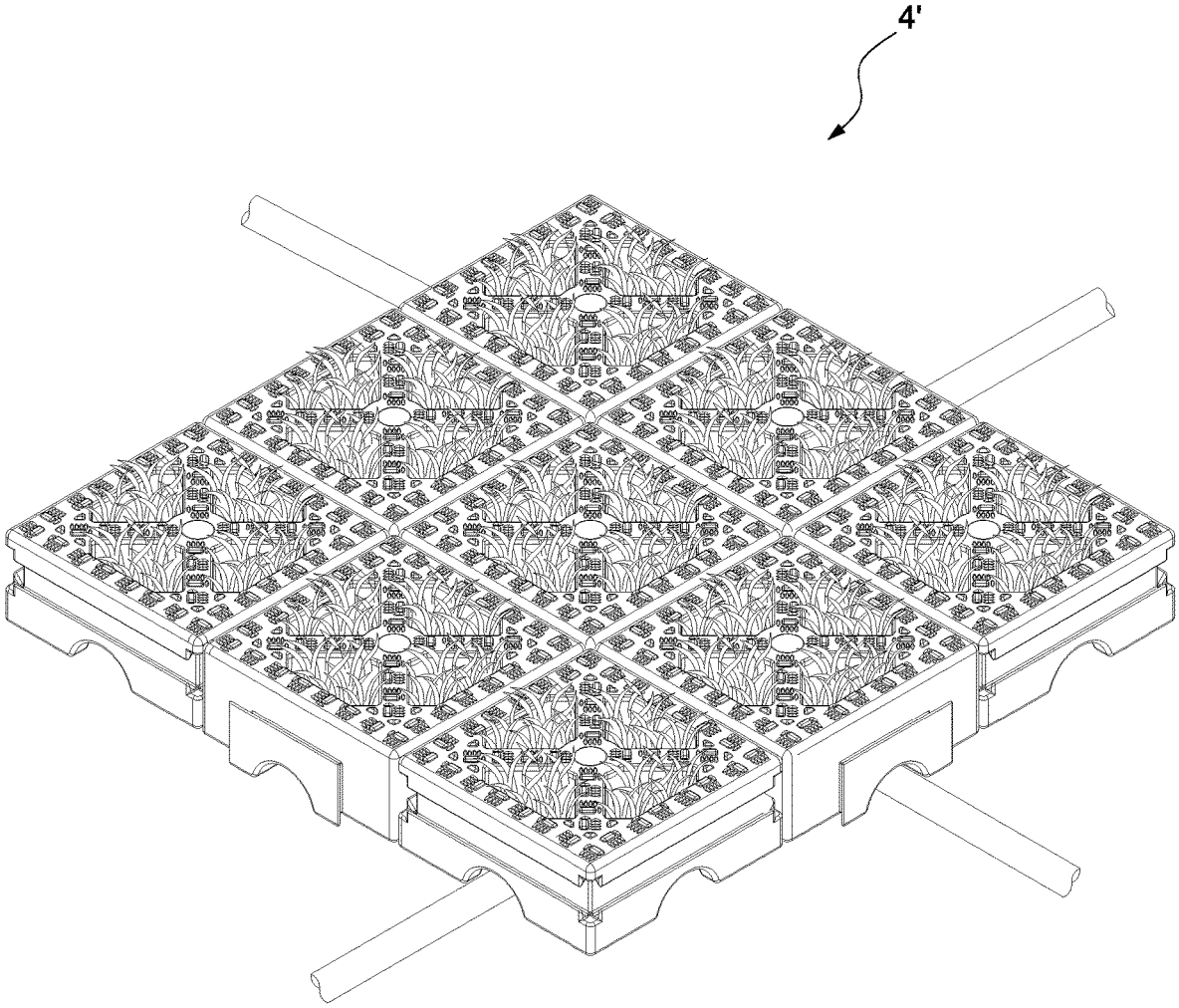
FIG. 14 illustrates the unit assembled brick with a plurality of planting holes of the subject invention.
Figure 15:
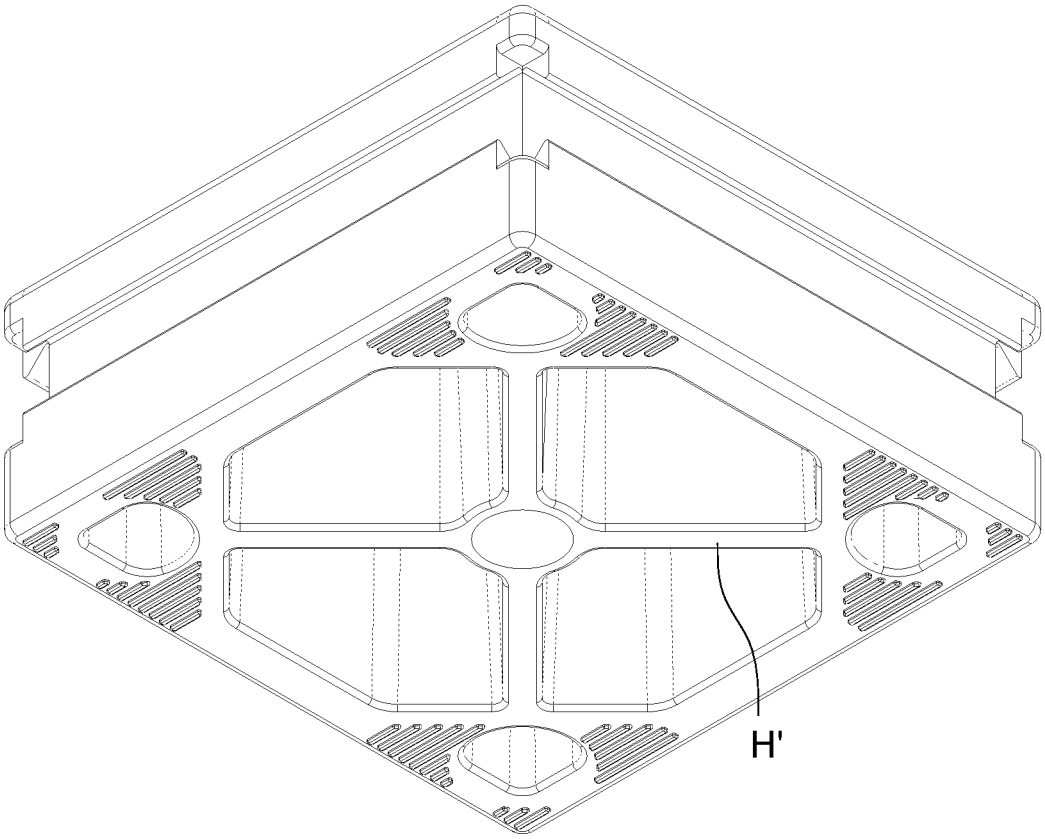
FIGS. 15 to 18 respectively illustrate first to fourth linkage bricks with a plurality of support ribs extending downwardly to and flush with the bottom face thereof.
Figure 16:
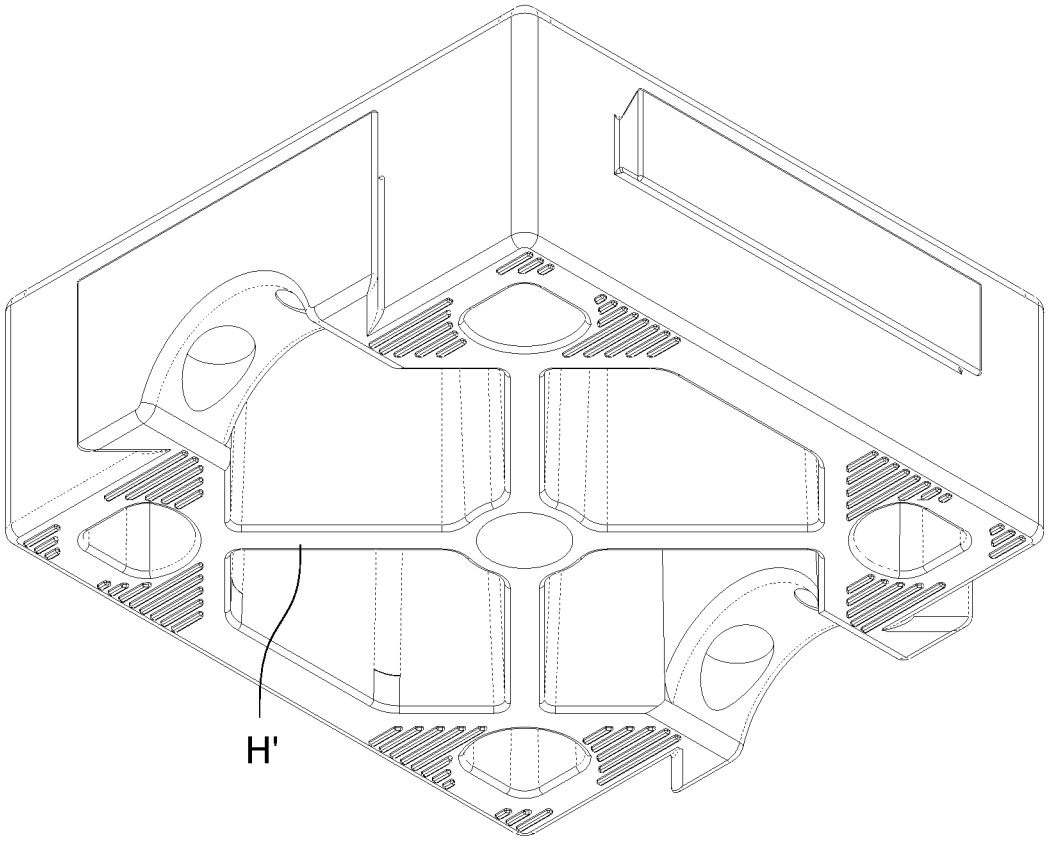
Figure 17:
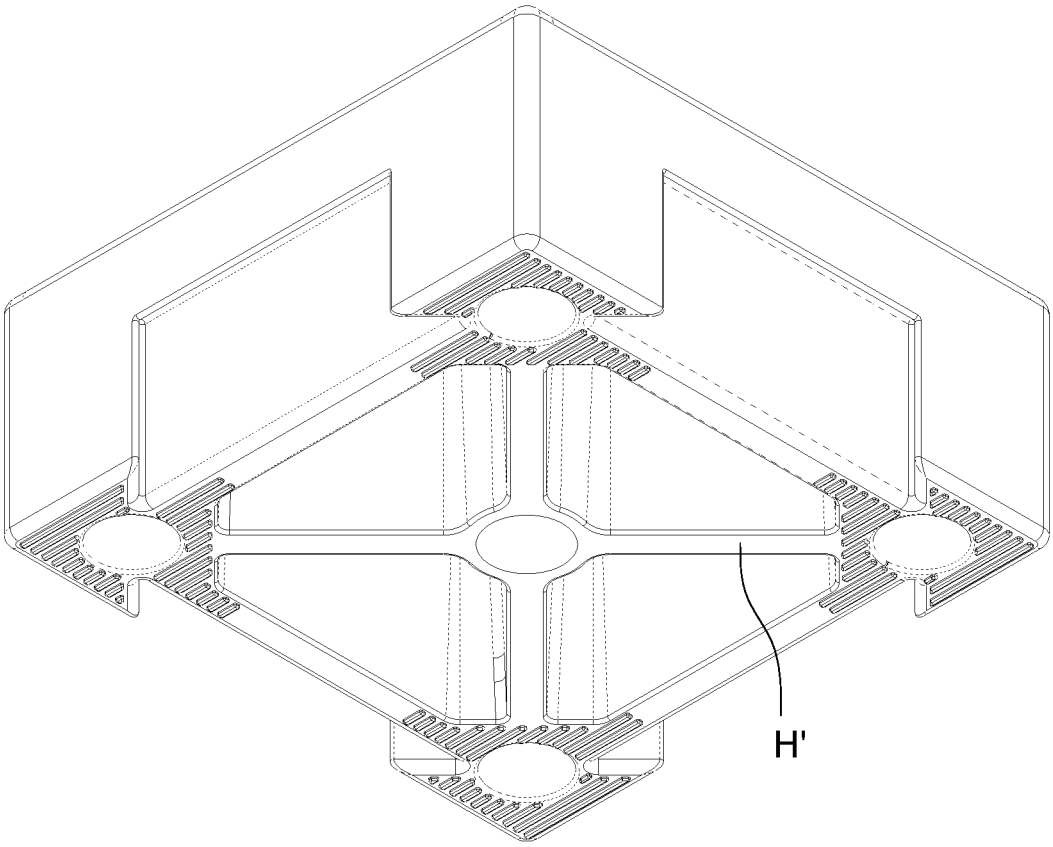
Figure 18:
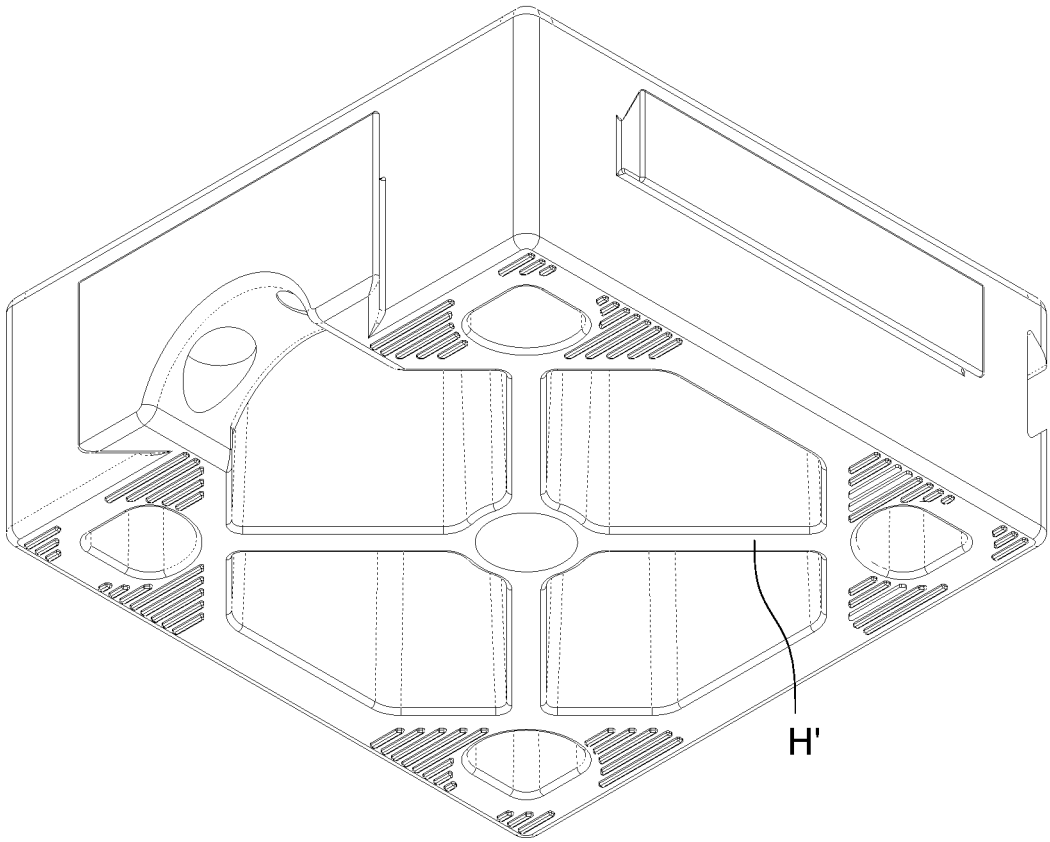

FIG. 8A illustrates an enlarged view of the slip-resistant patterns K. However, in other possible embodiments, the slip-resistant patterns K may also have other forms or different arrangements.

Referring to FIGS. 2-6 and 14, each of the linkage bricks 31, 32, 33, 34, 35 forms at least one through groove L connecting through at least two of the side faces. The through groove L is provided for at least one conduit to pass through.

In the preferable embodiments of the subject invention, the cross-section of the through groove L may be any shape suitable for a conduit to pass through (e.g., an arched shape).

It is noteworthy that, in a preferable embodiment, the through groove L does not extend to the traverse engaging grooves and the traverse engaging protrusions of the linkage bricks on side faces of the linkage bricks. In addition, the through groove L penetrates through the vertical engaging protrusion but does not go beyond any portion of the vertical engaging portion. Further, the though groove L preferably extends to the bottom face of the linkage bricks.

Referring to FIGS. 2C, 3D, 4D and 5D, the arrangement of the above structures of the linkage bricks 31, 32, 33, 34 can make the area of the bottom face of each of the linkage bricks 31, 32, 33, 34 which contacts the ground larger so as to increase the strength and stability of the linkage brick assembly.

FIGS. 9-14 illustrate the embodiment in which the planting holes M are disposed on the linkage bricks 31, 32, 33, 34 and the unit assembled brick 4. Each of the linkage bricks 31', 32', 33', 34' and the unit assembled brick 4' forms a plurality of planting holes M that hollow out the top face thereof. As shown in FIGS. 9-14, the linkage bricks 31', 32', 33', 34' and the unit assembled brick 4', which include planting holes M, have substantially the same structure as the linkage bricks and the unit assembled brick previously mentioned. Similarly, the unit linkage brick 35 may also have planting holes M, though they are not shown in the drawings.

In a preferable embodiment of the subject invention, every linkage brick has four planting holes M, each being located on each of the four triangular areas defined by the diagonals of the top face. In addition, the support ribs H extend along the diagonals.

In a preferable embodiment of the subject invention, the linkage bricks 31, 32, 33, 34, 35 are square. In addition, each of the linkage bricks is of the same size so that they can suitably match one another during the assembly process of the linkage brick assembly.

Furthermore, in a preferable embodiment of the subject invention, the linkage bricks 31, 32, 33, 34, 35 are preferably made of plastic, especially recycled plastic (for example: plastic bags, plastic containers) and thus have the advantage of being eco-friendly.

The embodiments set forth above may be liable to minor modifications based on the spirit of the subject invention. However, the subject invention with minor modifications based on the spirit of the subject invention should be deemed to lie within the scope of protection. Further, the above descriptions are intended only for elaboration but not to limit the subject invention.

What is claimed is:

1. A linkage brick assembly, comprising:

a plurality of second linkage bricks, each comprising a top face, a bottom face and four side faces between said top face and said bottom face, each of two opposite side faces of said side faces forming a traverse engaging protrusion extending laterally, and each of the other two opposite side faces of said side faces forming a vertical engaging protrusion extending vertically;

a plurality of third linkage bricks, each comprising a top face, a bottom face and four side faces between said top face and said bottom face, each of said side faces forming a vertical engaging groove extending vertically;

wherein a top face and an outer side face of each of said vertical engaging protrusions of said second linkage bricks defines a wedged corner, and each of said vertical engaging grooves of said third linkage bricks correspondingly forms a wedged grooved portion;

a plurality of unit linkage bricks, each comprising a top face, a bottom face and four side faces between said top face and said bottom face, each of said side faces forming a traverse engaging groove, a vertical engaging protrusion and a traverse engaging groove sequentially;

wherein said traverse engaging protrusions of said plurality of second linkage bricks are used to engage with said traverse engaging grooves of said plurality of unit linkage bricks through lateral sliding respectively; and wherein said vertical engaging grooves of said plurality of third linkage bricks are used to engage with said vertical engaging protrusions of said plurality of unit linkage bricks through downward sliding in order to connect to said plurality of unit linkage bricks.

* * * * *